US010358152B2

(12) United States Patent
Dyavanapalli

(10) Patent No.: US 10,358,152 B2
(45) Date of Patent: Jul. 23, 2019

(54) METHOD AND APPARATUS FOR GAUGE-FACE LUBRICATION

(71) Applicant: Loram Maintenance of Way, Inc., Hamel, MN (US)

(72) Inventor: Venkat Dyavanapalli, Glendale Heights, IL (US)

(73) Assignee: Loram Maintenance of Way, Inc., Hamel, MN (US)

( * ) Notice: Subject to any disclaimer, the term of this patent is extended or adjusted under 35 U.S.C. 154(b) by 757 days.

(21) Appl. No.: 14/839,091

(22) Filed: Aug. 28, 2015

(65) Prior Publication Data

US 2017/0057524 A1 Mar. 2, 2017

(51) Int. Cl.
*B61K 3/00* (2006.01)

(52) U.S. Cl.
CPC ..... *B61K 3/00* (2013.01)

(58) Field of Classification Search
CPC ..... B61K 3/00
USPC ..... 184/3.1
See application file for complete search history.

(56) References Cited

U.S. PATENT DOCUMENTS 2,995,210 A * 8/1961 Stemberger ..... B61K 3/00 184/3.1
3,015,370 A 1/1962 McWilliams
3,730,310 A 5/1973 Springer
D252,070 S 6/1979 Schindele
D257,337 S 10/1980 Black
4,585,214 A 4/1986 Cope
D301,435 S 6/1989 Martin
4,962,914 A 10/1990 Taylor
5,394,958 A * 3/1995 Junk ..... B61K 3/00 104/279
5,641,037 A * 6/1997 Wise ..... B61K 3/00 104/279

(Continued)

OTHER PUBLICATIONS http://www.lincolnindustrial.com/products/raillubrication/freightline.aspx, retrieved Feb. 13, 2017, 5 pages.

*Primary Examiner* — Michael R Mansen
*Assistant Examiner* — Mark K Buse
(74) *Attorney, Agent, or Firm* — Patterson Thuente Pedersen, P.A.

(57) ABSTRACT

A gauge-face lubrication assembly and related methods of use in which a removable and replacable applicator member is positioned proximate a gauge-face for lubrication of a rail member. Generally, the replaceable applicator member can be molded of a resilient polymeric material having shaped-memory properties. The replaceable applicator member includes one or more molded lubricant channels for delivering lubricant supplied by a lubrication system to the gauge-face. Each molded lubricant channel can include a molded seal for sealably engaging a lubrication bracket that retains the applicator member in position against the gauge-face. The removable applicator member can further include a liner for physically engaging the gauge-face and protecting removable applicator member. The applicator member can include a coupling portion that insertably interfaces with a bracket channel defined in the lubrication bracket, whereby the applicator member can be removed and replaced in the event of damage or wear.

19 Claims, 32 Drawing Sheets

(56) References Cited

U.S. PATENT DOCUMENTS 5,722,509 A * 3/1998 Clinger ..... B61K 3/00 138/106
D486,248 S 2/2004 Sudano
D489,137 S 4/2004 Eichner et al.
D489,464 S 5/2004 Barnett
D489,828 S 5/2004 Barnett
D505,210 S 5/2005 Eichner et al.
D546,479 S 7/2007 Aughton et al.
D546,974 S 7/2007 Aughton et al.
D547,883 S 7/2007 Aughton et al.
D547,884 S 7/2007 Aughton et al.
D547,885 S 7/2007 Aughton et al.
7,273,131 B2 9/2007 Urmson, Jr. et al.
D638,778 S 5/2011 Giddens
8,074,772 B2 * 12/2011 Urmson, Jr. ..... B61K 3/00 184/3.1
D666,320 S 8/2012 Morton
D666,322 S 8/2012 Morton
D666,324 S 8/2012 Morton
D666,742 S 9/2012 Wiesemann
D674,122 S 1/2013 Sims
D674,513 S 1/2013 Liu
D708,353 S 7/2014 Oetlinger
8,795,106 B2 8/2014 Guertin
D721,989 S 2/2015 Behrens et al.
D801,226 S * 10/2017 Dyavanapalli ..... D12/49
2007/0204705 A1 * 9/2007 Kumar ..... H03M 7/30 73/866.5
2008/0047780 A1 * 2/2008 Urmson, Jr. ..... B61K 3/00 184/3.1
2008/0083584 A1 * 4/2008 Urmson, Jr. ..... B61K 3/00 184/3.1
2008/0223661 A1 * 9/2008 Singleton ..... B61K 3/00 184/3.1
2009/0000869 A1 * 1/2009 Holland ..... B61K 3/00 184/3.1
2009/0050409 A1 * 2/2009 Wakamatsu ..... B61K 3/00 184/3.1
2009/0095570 A1 * 4/2009 Gunacker ..... B61K 3/00 184/3.1
2009/0146436 A1 6/2009 Lindgren et al.
2010/0300810 A1 * 12/2010 Singleton ..... B61K 3/00 184/3.1
2012/0126073 A1 * 5/2012 Singleton ..... B61K 3/00 248/201
2014/0054113 A1 * 2/2014 Powell ..... B61K 3/00 184/3.1
2014/0060972 A1 * 3/2014 Appleby ..... E01B 7/26 184/3.1
2016/0264159 A1 * 9/2016 Graham ..... B61K 3/00

* cited by examiner

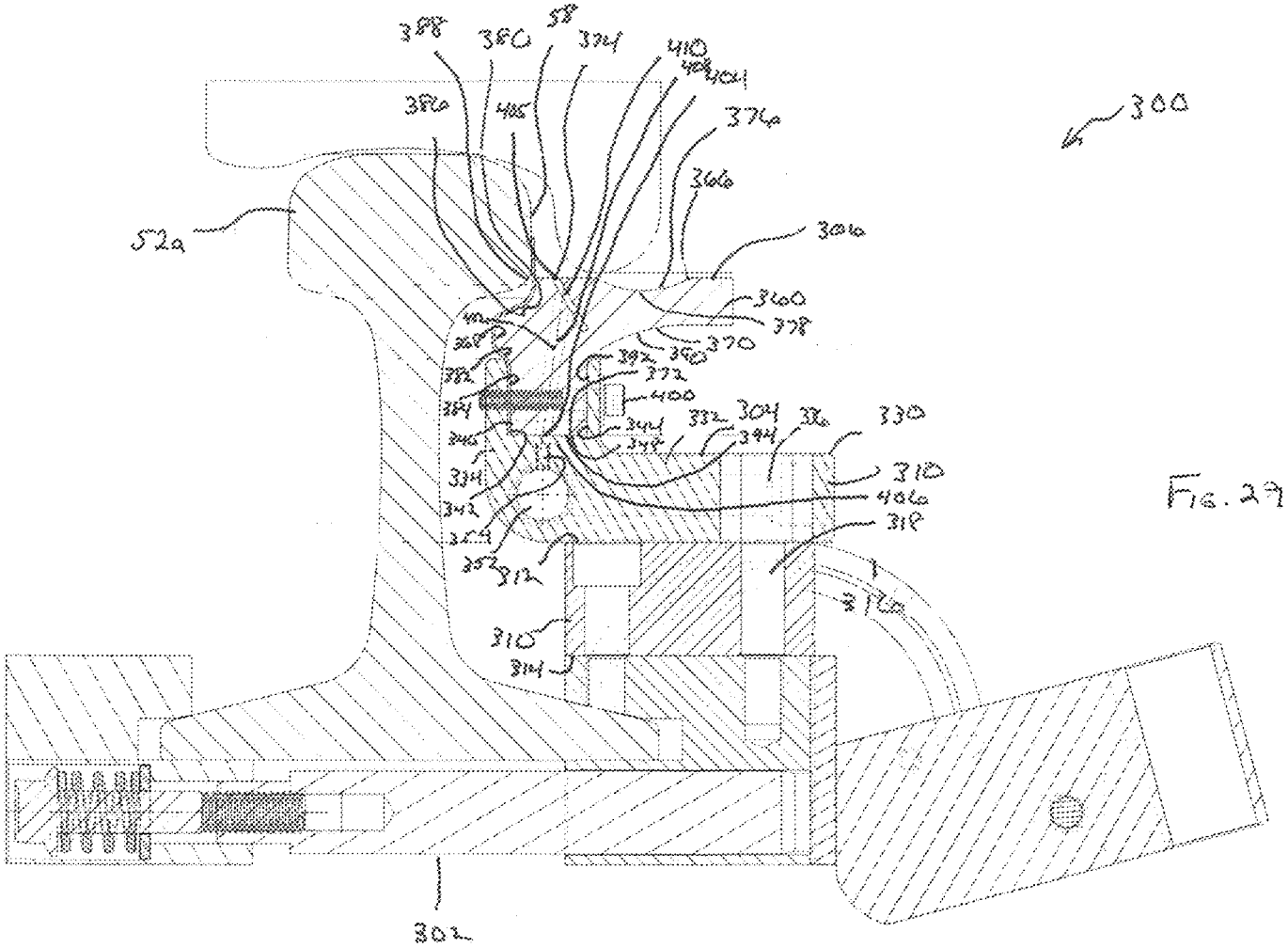
300
302
310
312
314
316
318
320
322
324
330
332
334
340
342
344
346
348
350
360
362
364
366
368
370
372
374
376
378
380
382
384
386
388
390
392
394
400
406
408
410
412
414
416
418
420
422
424
426
428
430
432
434
436
438
440
442
444
446
448
450
452
454
456
458
460
462
464
466
468
470
472
474
476
478
480
482
484

METHOD AND APPARATUS FOR GAUGE-FACE LUBRICATION

FIELD OF THE INVENTION

The present invention is generally directed to the field of rail lubrication. More specifically, the present invention is directed to a gauge-face rail lubrication assembly that includes a removable and replacable applicator for applying and retaining lubricant on a gauge-face surface of a length of rail.

BACKGROUND OF THE INVENTION

Rail lubrication is commonly employed by the railroad industry to reduce track wear in high friction locations. Examples of these locations can include, for example, curves, switches and hump/switching yards. Through the application of suitable lubricants, the coefficient of friction can be significantly reduced at these high friction locations, which can help with extending the usable life of the rail and reduce associated maintenance costs.

When rail is laid down to form a railway, each individual rail defines a gauge-face, a field face and a crown or top of rail. The gauge-face of each rail generally faces inwardly of the railway and toward a second parallel length of rail that cooperatively define the railway while the field face of each rail generally faces outward from the railway. The gauge-face generally interfaces with a wheel flange of a rail car as the rail car traverses the rail, while a wheel surface rolls along the crown. As the gauge-face and the crown are the portions of the rail that continually interface with wheels of the rail cars, these are also the portions of the rail where application of lubricant is beneficial.

A variety of difficulties are encountered when attempting to lubricate the gauge-face of the rail. First, the gauge-face defines a generally vertical surface that can make it difficult to retain lubricant for application to passing wheel flanges. Secondly, the potential exists for physical contact between the passing wheel flanges and a gauge-face lubrication assembly, such that substantial damage can be inflicted to gauge face lubrication assembly as part of its operation. As such, it would be advantageous to further improve upon conventional gauge-face lubrication assemblies to increase their effectiveness and reliability.

SUMMARY OF THE INVENTION

A gauge-face lubrication assembly according to the present disclosure can comprise a removable and replacable applicator member that is molded from a resilient material such that lubricant can be delivered to and retained at the gauge-face for application to passing wheel flanges along the gauge-face of a rail member. Generally, the applicator member can be molded to include one or more molded lubricant channels for delivering lubricant supplied by a lubrication system to the gauge-face. In some embodiments, each molded lubricant channel can include a molded seal for sealably engaging a lubrication bracket that retains the applicator member in position against the gauge-face. The removable applicator member can further include a liner for physically engaging the gauge-face and protecting an engagement edge of the removable insert. The applicator member can include a coupling portion that insertably interfaces with a bracket channel defined in the lubrication bracket, whereby the applicator member can be removed and replaced in the event of damage or wear.

In one representative embodiment, a gauge-face lubrication assembly of the present invention can comprise a rail clamp assembly, a vertical positioning member, a bracket assembly and an applicator member. The applicator member can molded of suitable materials and be removably attachable to the bracket assembly for replacement of the applicator member in the event of damage or wear to the applicator member. The applicator member can comprise a plurality of lubrication flow channels for delivering a lubricant onto a gauge-face of a rail member. The applicator member can comprise an upper application surface for maintaining the lubricant in proximity to the gauge-face. The lubrication flow channels can be supplied lubrication from a central lubrication channel in the bracket assembly that receives lubrication from a remote lubricant supply. In some embodiments, the vertical positioning member can have a selected positioning height to position the applicator member in a desired location relative to the gauge-face of the rail member.

In another representative embodiment, a method for gauge-face lubrication of a rail member can comprise coupling a gauge-face lubrication assembly to the rail member in a desired location for application of lubricant. The method can further comprise attaching a replaceable applicator member to a bracket assembly, whereby said attachment fluidly interconnects a plurality of lubrication channels in the replaceable applicator member with a central lubrication channel in the bracket assembly. The method can further comprise supplying lubricant to the central lubrication channel, whereby the lubricant is subsequently directed onto and/or into proximity with a gauge-face on a rail member. In some embodiments, the method can further comprise removing a damaged or worn applicator member and attaching a new applicator member to the bracket assembly, such that a plurality of lubrication channels in the new applicator assembly are fluidly interconnected to the central lubrication channel. In some embodiments, a vertical positioning member having a selected positioning height can be positioned to support the bracket assembly, whereby the replaceable applicator member is suitably positioned relative to the gauge-face of the rail member.

In another representative embodiment, a replaceable lubrication applicator can be molded of polymeric materials having shaped-memory features as well as being compatible with hydrocarbon based lubricants and environmental conditions including temperature extremes and precipitation. The replaceable lubrication applicator can be molded to define a plurality of lubrication flow channels between an upper application surface and a lower engagement surface. Each lubrication flow channel can include a transport portion and an applicator portion that insects the transport portion at an angle so as to direct lubricant out a lubrication outlet and onto a gauge-face of a rail member. Each lubrication flow channel can include a lubrication inlet defined in the lower engagement surface and can include a molded inlet seal at each lubrication inlet. The replaceable lubrication applicator can comprise an applicator engagement portion that is slidably insertable into a cavity on bracket assembly such that the replaceable lubrication applicator can be replaced in the event of damage or wear. The applicator engagement portion can include a plurality of molded apertures allowing for connection to the bracket assembly, whereby the molded apertures can include rigid aperture liners to provide retention strength to the replaceable lubrication assembly. The replaceable lubrication applicator can further comprise an applicator liner offering protection as the replaceable lubrication applicator contacts the gauge-face.

In another representative embodiment, a rail lubrication assembly can comprise a gauge-face lubrication assembly having a replaceable applicator member. The replaceable applicator member can be molded of polymeric materials having shaped-memory features as well as being compatible with hydrocarbon based lubricants and environmental conditions including temperature extremes and precipitation. The replaceable lubrication applicator can be molded to define a plurality of lubrication flow channels between an upper application surface and a lower engagement surface so as to delivery lubricant from a remote lubrication supply to a gauge-face of a rail member. The replaceable applicator member can be replaced with a new replaceable applicator member in the event of damage or wear, wherein attachment of the new replaceable applicator member to a bracket member fluidly couples lubrication flow channels on the new applicator member to the remote lubrication supply.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which:

FIG. 29 is a section view of the gauge-face lubrication assembly of FIG. 26 taken at line 29-29 of FIG. 33.

Figure 1:
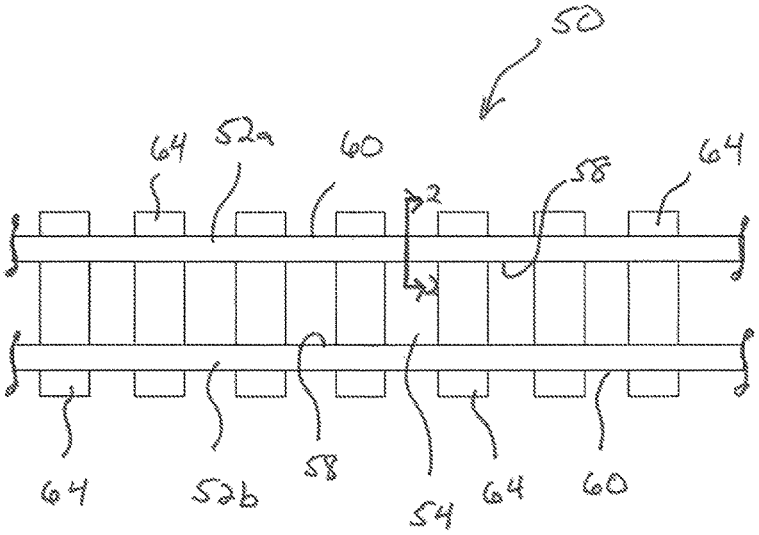
FIG. 1 PRIOR ART
FIG. 1 is a top view of a railway.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Figure 2:
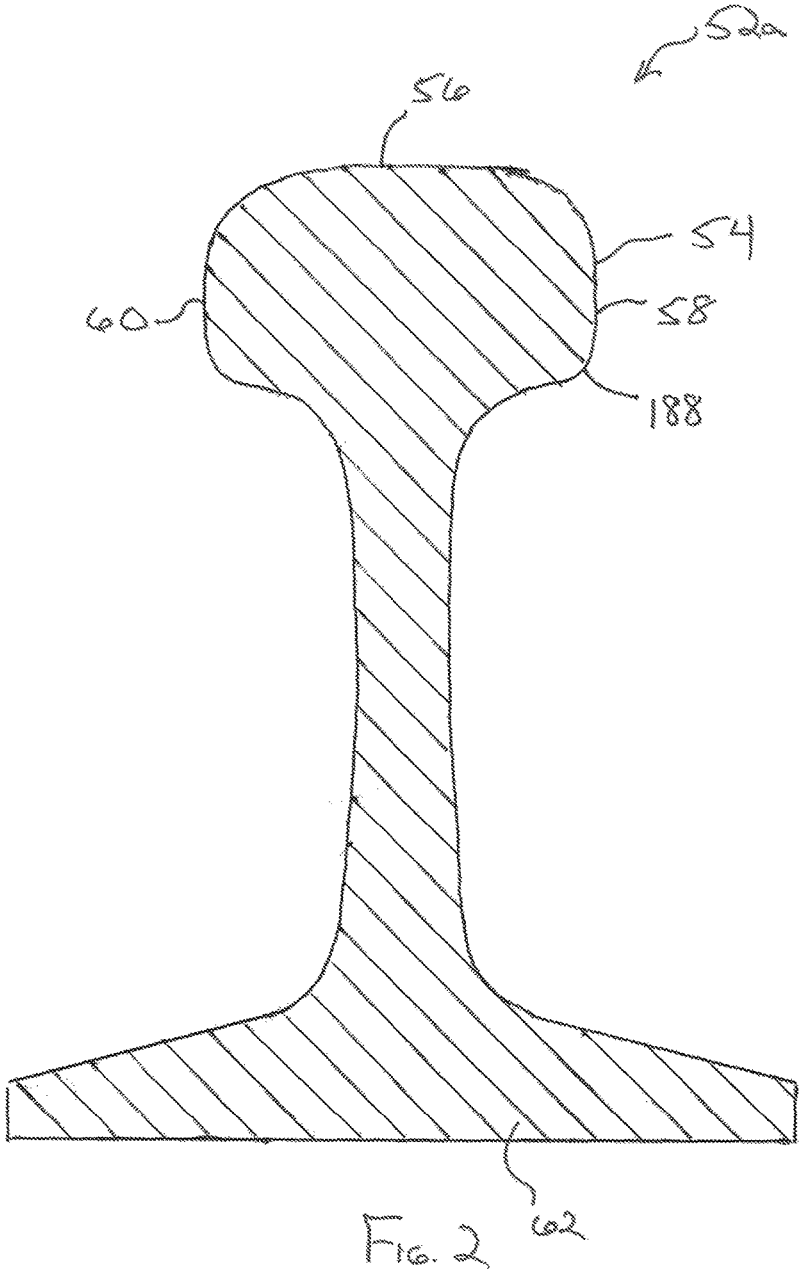
FIG. 2 PRIOR ART
FIG. 2 is a section view of a rail member.

Referring generally to FIGS. 1 and 2, a railway 50 generally comprises a pair of rail members 52*a*, 52*b* that lie on a railbed 54 in a parallel relationship with one another. Each rail member 52*a*, 52*b* generally has a rail profile 54 that includes a crown 56 upon which a rail wheel rotates. Rail profile 54 further defines a gauge-face 58 and a field face 60, with the gauge-face 58 facing internally toward an opposed rail member and the field face 60 facing externally, away from the railbed 54. Each rail member 52*a*, 52*b* includes a rail base 62 that is used to secure the rail members 52*a*, 52*b* to the supporting rail ties 64 on the railbed 54.

Figure 3:
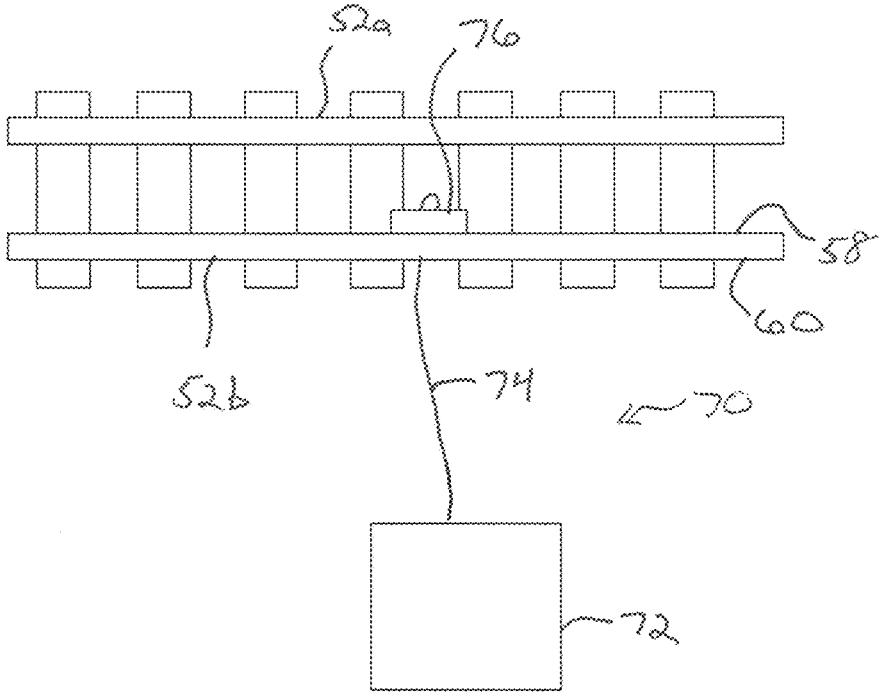
PRIOR ART FIG. 3
FIG. 3 is a top view of a gauge-side rail lubrication system of the prior art.

In high friction locations such as, for example, at curves and switching/hump yards, a rail lubrication system 70 can be utilized to apply a lubricant to the rail members 52*a*, 52*b* so as to reduce friction and extend service life. Typically, the rail lubrication system 70 will includes a remote lubrication supply 72, a lubricant supply hose 74 and a lubricant applicator 76 as shown in FIG. 3. The remote lubrication supply 72 can include a lubricant reservoir, a control system and a pump system. At the direction of the remote lubrication supply 72, lubricant is pumped through the lubricant supply hose 74 and to the lubricant applicator 76, whereby the lubricant is applied to the rail. In some instance, the rail lubrication supply can be configured as a top-of-rail lubrication system in which lubricant is applied to the crown 56. With top-of-rail lubrication systems, the lubricant applicator 76 is generally positioned in proximity to the field face 60. Alternatively, lubricant can be applied to the gauge-face 58 so as to provide lubrication to passing wheel flanges. With gauge-face lubrication system, the lubricant applicator 76 is generally positioned proximate the gauge-face 58. One drawback of gauge-face lubrication is that the lubricant applicator 76 is located in a position of potential damage from passing wheel flanges.

As illustrated in FIGS. 4-25, a representative embodiment of a gauge-face lubrication assembly 100 of the present invention generally comprises a rail clamp assembly 102, a vertical positioning member 103, a bracket assembly 104 and an applicator member 106. Rail clamp assembly 102 and bracket assembly 104 are generally fabricated of materials suited to rail use and generally are constructed of carbon steel.

As seen in FIGS. 4, 6, 7, 13 and 14, rail clamp assembly 102 generally comprises a field side coupling member 110, a gauge side coupling member 112 and a fastening member 114. The field side coupling member 110 defines a field side engagement cavity 116 while the gauge side coupling member 112 defines a gauge side engagement cavity 118. The gauge side coupling member 112 can further comprise one or more mounting apertures 120. Using the fastening member 114, the field side coupling member 110 and the gauge side coupling member 112 can be positioned such that the rail base 62 can be captured within the field side engagement cavity 116 and the gauge side engagement cavity 118 so as to mount the gauge-face lubrication assembly 100 to the rail member 52*a*.

Referring to FIGS. 4, 5, 7 and 15, vertical positioning member 103 generally comprises a body member 122 having an upper surface 123 and a lower surface 124 defining a positioning height 125. The vertical positioning member 103 generally includes a plurality of positioning bores 126 that extend between the upper surface 123 and lower surface 124. Vertical positioning member 103 can have a positioning length 127 between a first end 128 and a second end 129 that corresponds either to a length of the rail clamp assembly 102, thus requiring multiple vertical positioning members 103, or alternatively, to a length of the bracket assembly 104 such that only one vertical positioning member 103 is required.

As seen in FIGS. 4, 5, 8 and 16-18, the bracket assembly 104 generally comprises a bracket body 130 having a coupling portion 132 and an applicator portion 134. The bracket body 130 has a bracket length 135 defined between a first end 135*a* and a second end 135*b* that can range from about 24 to about 72 inches in length. Generally, the coupling portion 132 defines one or more coupling apertures 136 for receiving a coupling fastener 138 so as to mechanically couple the vertical positioning member 103 and bracket assembly 104 to the gauge side coupling member 112 using positioning bores 126 and the mounting apertures 120. The applicator portion 134 generally defines an applicator cavity 140 having a cavity width 141 defined between a front applicator wall 142 and a rear applicator wall 144. Spaced along bracket length 135, both the front applicator wall 142 and rear applicator wall 144 include a plurality of corresponding bracket fastener apertures 146. The applicator cavity 140 defines a cavity floor 148 that includes a plurality of spaced apart cavity recesses 150 along the bracket length 135. The bracket body 130 includes a central lubrication channel 152 along the bracket length 135 with a plurality of branch lubrication channels 154 that fluidly interconnect the central lubrication channel 152 with the individual cavity recesses 150. The central lubrication channel 152 is supplied by an inlet channel 153 having a bracket lubrication inlet 156 and that is fluidly connected to the lubricant supply hose 74.

Referring to FIGS. 4, 5, 7, 8 and 19-21, the applicator member 106 generally comprises an applicator body 160 having an applicator length 162 between end walls 163*a*, 163*b*. Applicator length 162 generally corresponds to the bracket length 135. The applicator member 106 comprises a molded, polymeric member that can be formed of suitable polymers including epoxies. Preferably, the applicator member 106 is molded from a polymer that has properties including shaped memory allowing the applicator member 106 to return to its original state in the event o contact with passing wheel flanges. In addition, the applicator member 106 is preferably molded of materials having compatibility with hydrocarbon-based lubricants and that is suited for use in an outdoor environment, i.e., exposure to sun, precipitation and temperature extremes. Generally, the applicator member 106 has a side profile 164 defined by an upper application surface 166, a forward surface 168, a rear surface 170 and a lower engagement surface 172. Upper application surface 166 generally includes an application contact portion 174 and a retention portion 176. Retention portion 176 can comprise an arcuate depression 178 or a similar channel. Forward surface 168 can comprise a notched portion 180, a projecting portion 182 and a forward engagement portion 184. In some embodiments, notched portion 180 can comprise an arcuate region 186 or corner that can be molded to conform to or substantially match with a corresponding engagement region 188 on the gauge-face 58 of the rail member 52*a*. Rear surface 170 generally comprises an exposed rear surface 190 and a rear engagement portion 192. Lower engagement surface 172 generally has a flat bottom surface 194 defining an engagement width 195 between the front engagement portion 184 and the rear engagement portion 192. Engagement width 195 generally matches the cavity width 141 such that an applicator engagement portion 196 is slidably insertable into the applicator cavity 140. Applicator member 106 further comprises a plurality of applicator fastener apertures 198 extending between the forward engagement portion 184 and the rear engagement portion 192. The quantity and position of the applicator fastener apertures 198 generally correspond with the quantity and position of the bracket fastener apertures 146 such that fasteners 200 can selectively couple and uncouple the applicator member 106 from the bracket assembly 104. The applicator fastener apertures 198 can include a rigid aperture liner 199 that can be removably inserted or molded into the applicator body 160 to provide additional retention strength to the applicator member 106.

With reference to FIGS. 5, 7, 8, 19 and 20, applicator member 106 defines a plurality of lubrication flow channels 202 spaced along applicator length 162. Each lubrication flow channel 202 generally include a lubrication inlet 204 defined in the lower engagement surface 172 and a lubrication outlet 205 defined in the upper application surface 166. An inlet seal member 206 can be molded to each lubrication inlet 204. The position of the lubrication flow channels 202 and each lubrication inlet 204 along the applicator member 106 generally corresponds to the position of the branch lubrication channels 154 along the bracket length 135 of the bracket body 130. As the applicator engagement portion 196 is inserted into the applicator cavity 140, each inlet seal member 206 can be placed into the corresponding cavity recess 150, such that the lubrication inlet 204 is fluidly interconnected with and sealingly engaged to the corresponding branch lubrication channel 154. In order to promote even application of lubrication along the length of the applicator member 106, the diameter of the lubrication flow channels 202 may be varied based upon their distance from a lubrication source on the central lubrication channel 152. Each lubrication flow channel 152 generally comprises a transport portion 208 and an application portion 210. Application portion 210 resides at a non-transverse angle relative to the upper application surface 166 such that as the lubricant exits the lubrication outlet 205, the lubricant is dispensed at and/or sprayed directly onto the gauge-face 58.

Gauge-face lubrication assembly 100 can further comprise an applicator liner 220 as shown in FIGS. 4, 5, 7, 8, 22 and 23. Applicator liner 220 can comprises a thin walled body 222, preferably made of a suitable metal material such as, for example, stainless steel, aluminum or the like. Generally, applicator liner 220 has a liner length 224 that is substantially similar to the bracket length 135 and the applicator length 162. Thin walled body 222 is generally formed so as to substantially resemble the profile of the forward surface 168. Applicator liner 220 generally comprises a plurality of liner fastener apertures 226 that are spaced so as to correspond to the quantity and position of the applicator fastener apertures 198 and the bracket fastener apertures 146. In this way, applicator liner 220 can be positioned between the forward engagement portion 184 and the front applicator wall 142 as the engagement portion 196 is slidably insertable into the applicator cavity 140, whereby fastener 200 can pass through the liner fastener aperture 226 as the applicator member 106 is coupled to the bracket assembly 104. In some embodiments, applicator liner 220 can be permanently coupled to the applicator member 106, for example, adhesively or through a suitable molding technique, such that the applicator member 106 and applicator liner 220 comprise a substantially integral structure that is attached and removed from the bracket assembly 104 as a single component. Alternatively, the applicator liner 220 can comprise a substantially stand alone component such that it can be reused repeatedly with different applicator members 106 as these applicator members 106 are replaced. Alternatively, the applicator member 106 can avoid utilization of the applicator liner 220 in situations in which the forward surface 168 sufficiently matches a profile of gauge face 58 such that applicator liner 220 is not required.

Figure 4:
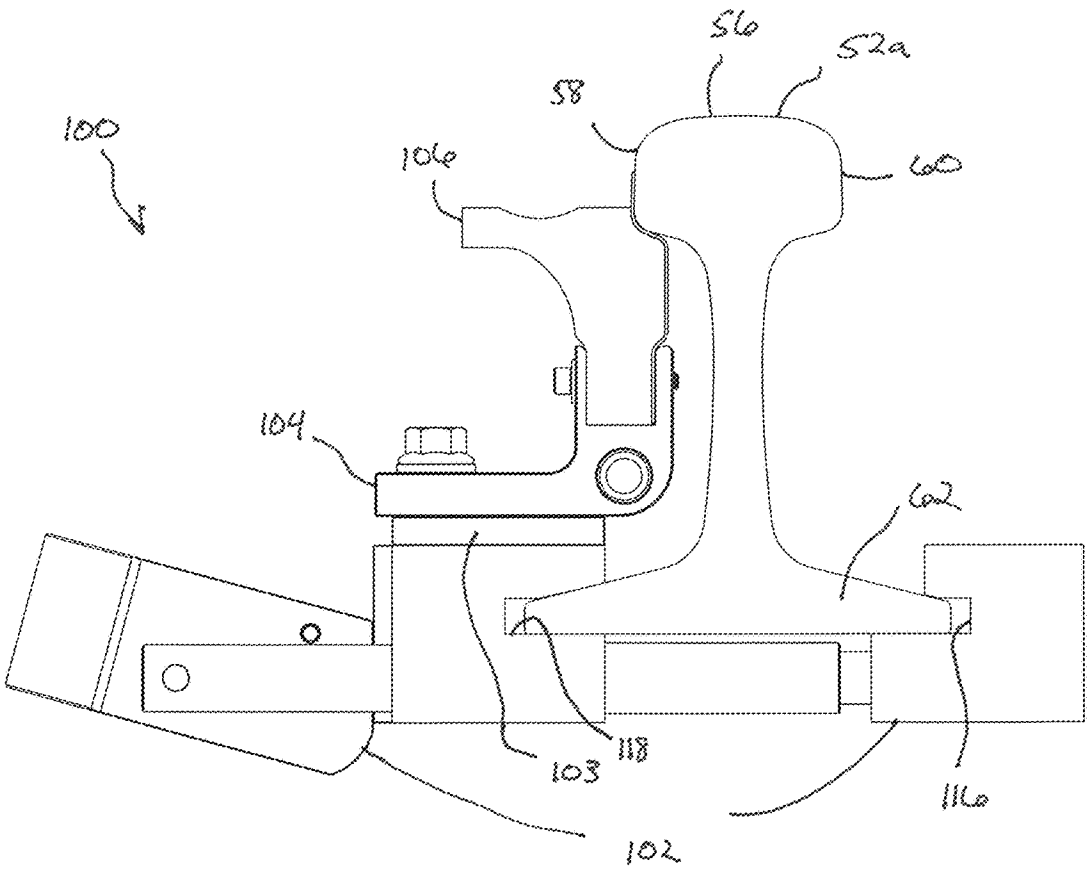
FIG. 4 is an end view of a gauge-face lubrication assembly according to a representative embodiment of the present invention.
Figures 5, 6:
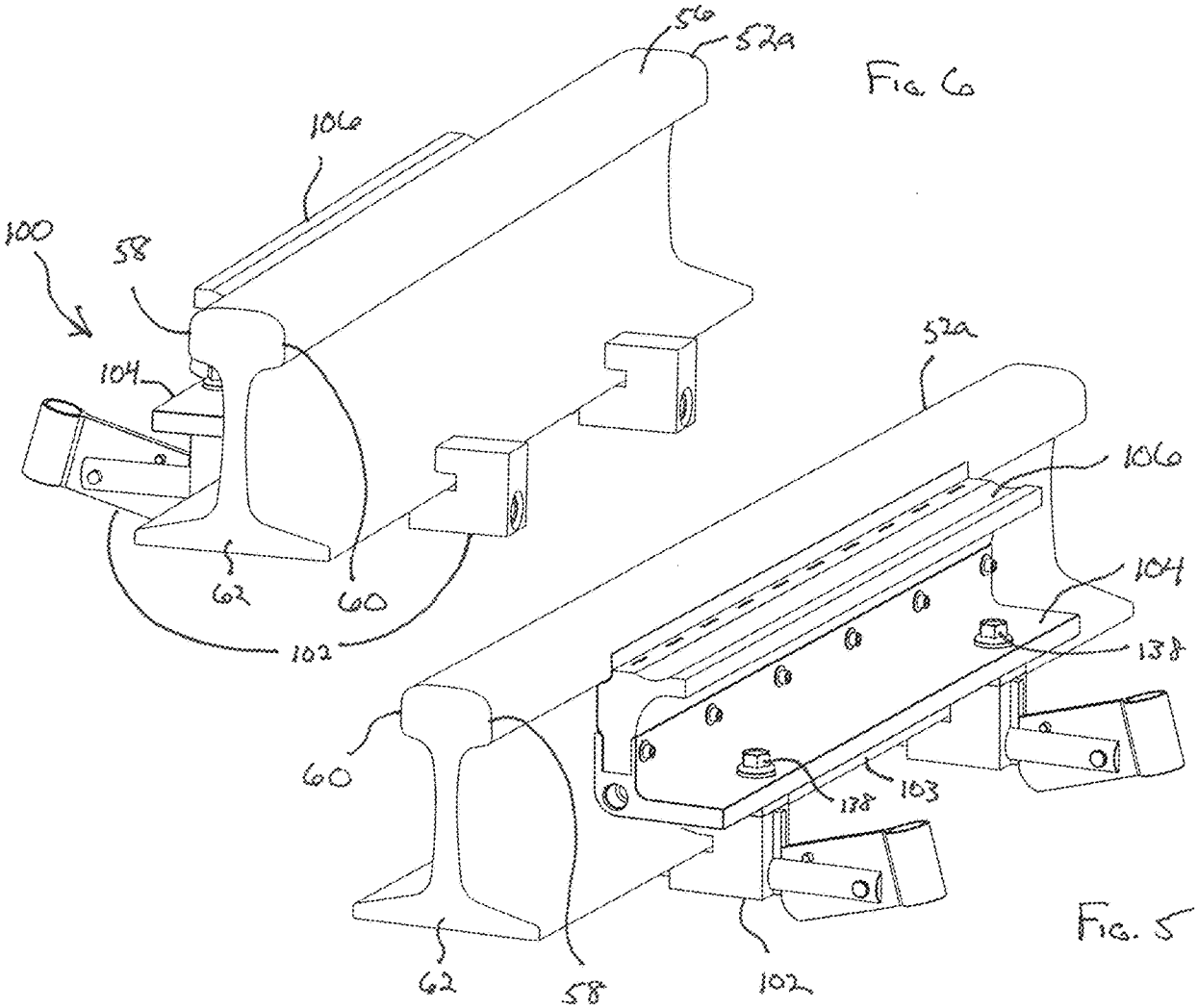
FIG. 5 is a gauge-side perspective view of the gauge-face lubrication assembly of FIG. 4.
FIG. 6 is a field-side perspective view of the gauge-face lubrication assembly of FIG. 4.
Figure 7:
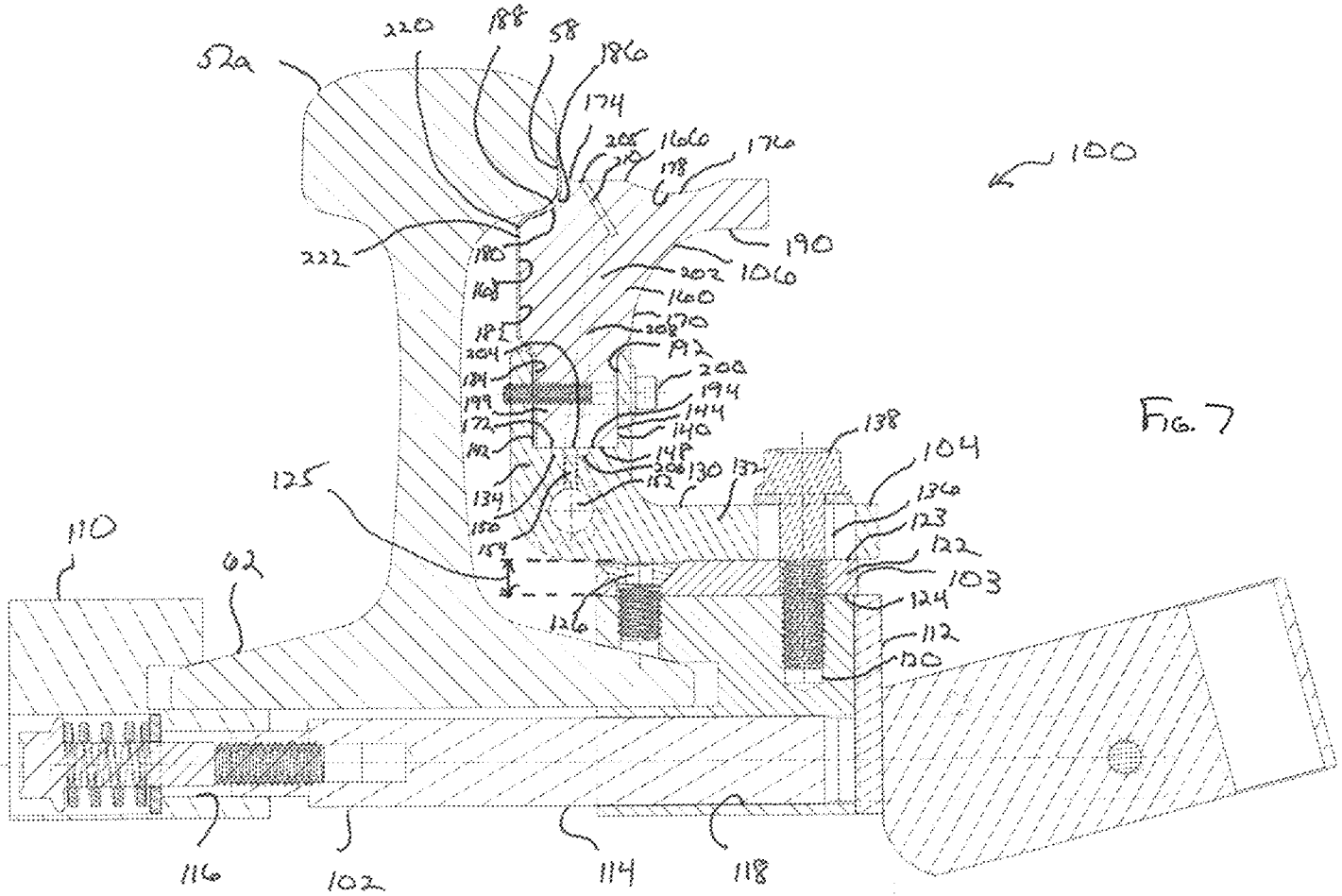
FIG. 7 is a section view of the gauge-face lubrication assembly of FIG. 4 taken at line 7-7 of FIG. 11.
Figure 8:
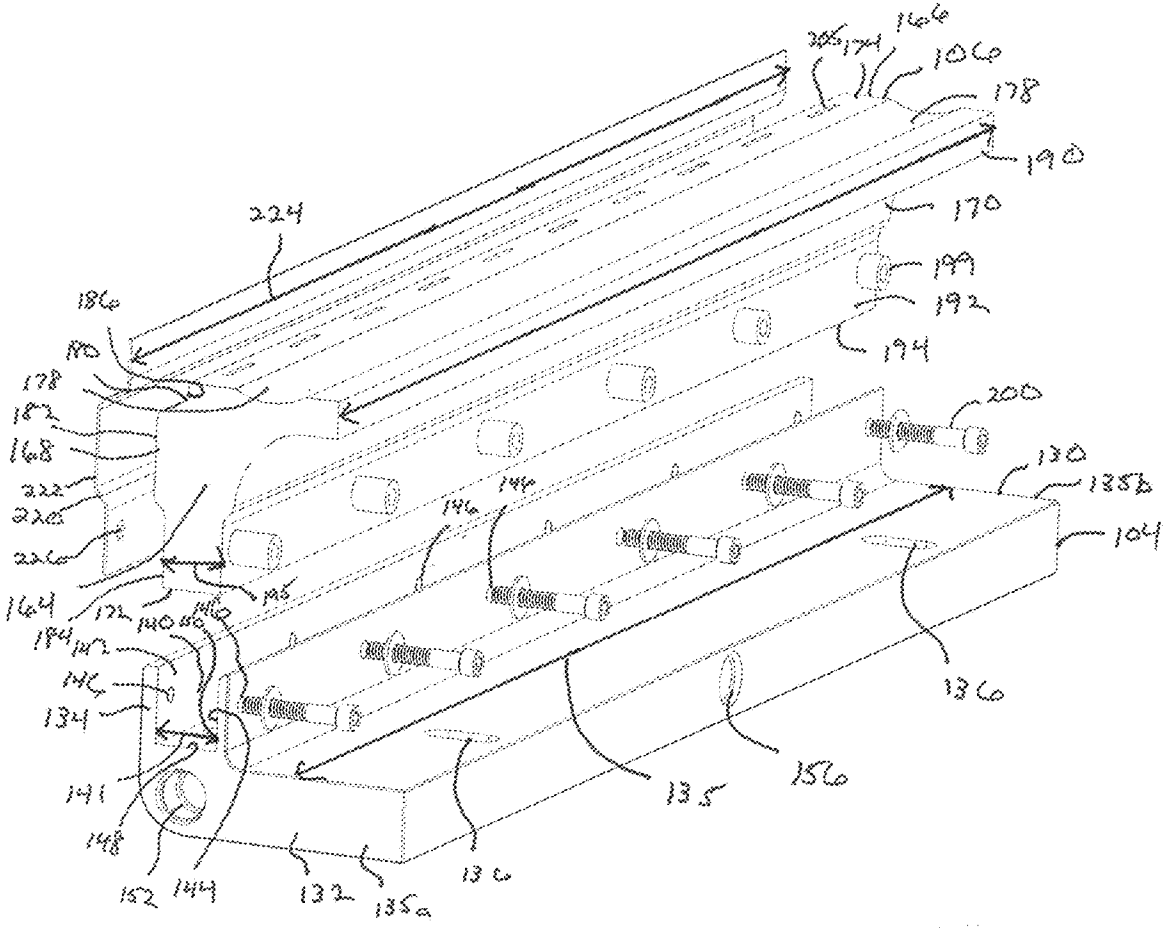
FIG. 8 is a gauge-side, exploded, perspective view of a bracket body, applicator member and applicator liner of the gauge-face lubrication assembly of FIG. 4.
Figure 10:
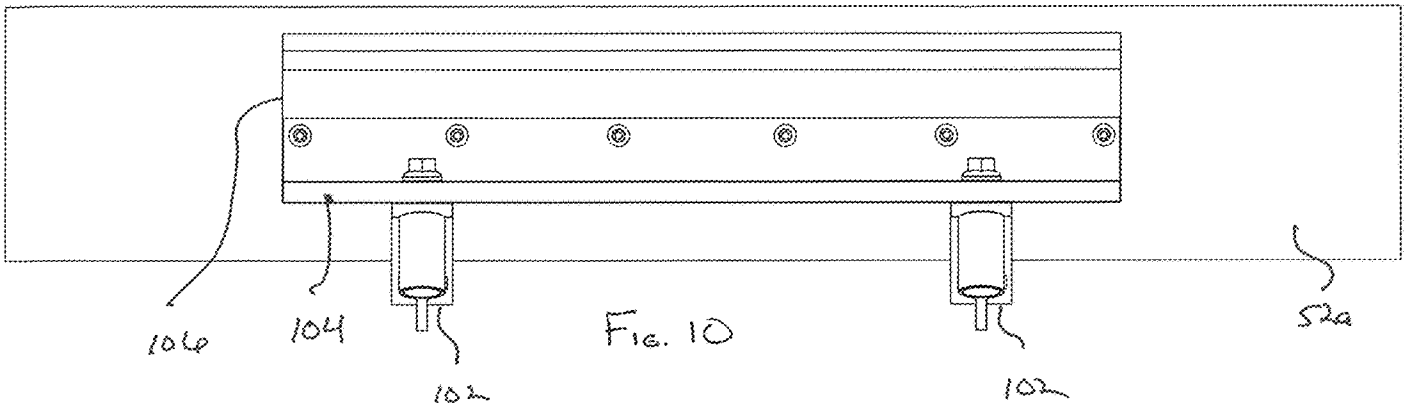
FIG. 10 is a gauge-side view of the gauge-face lubrication assembly of FIG. 4.
Figure 9:
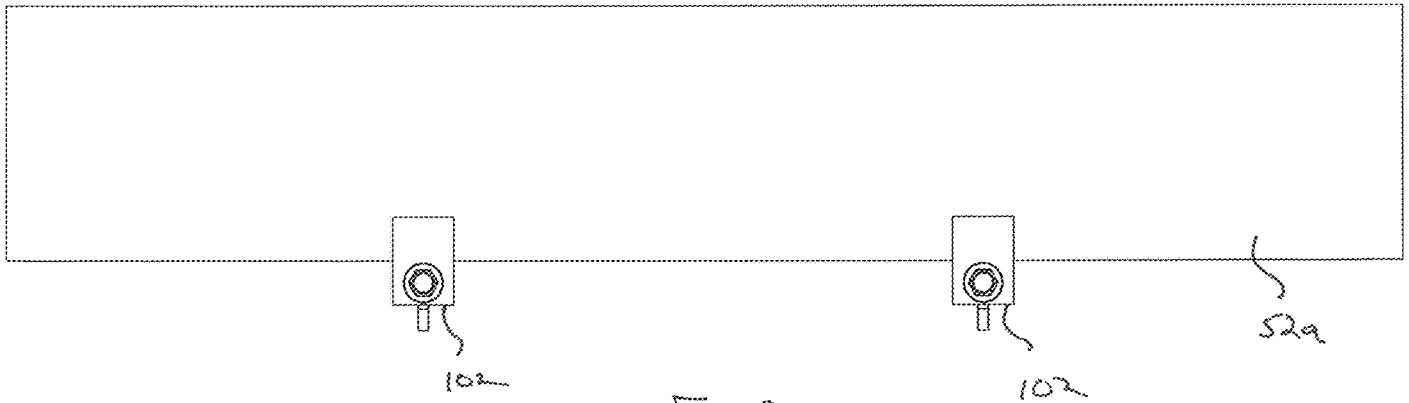
FIG. 9 is a field-side view of the gauge-face lubrication assembly of FIG. 4.
Figures 11, 12:
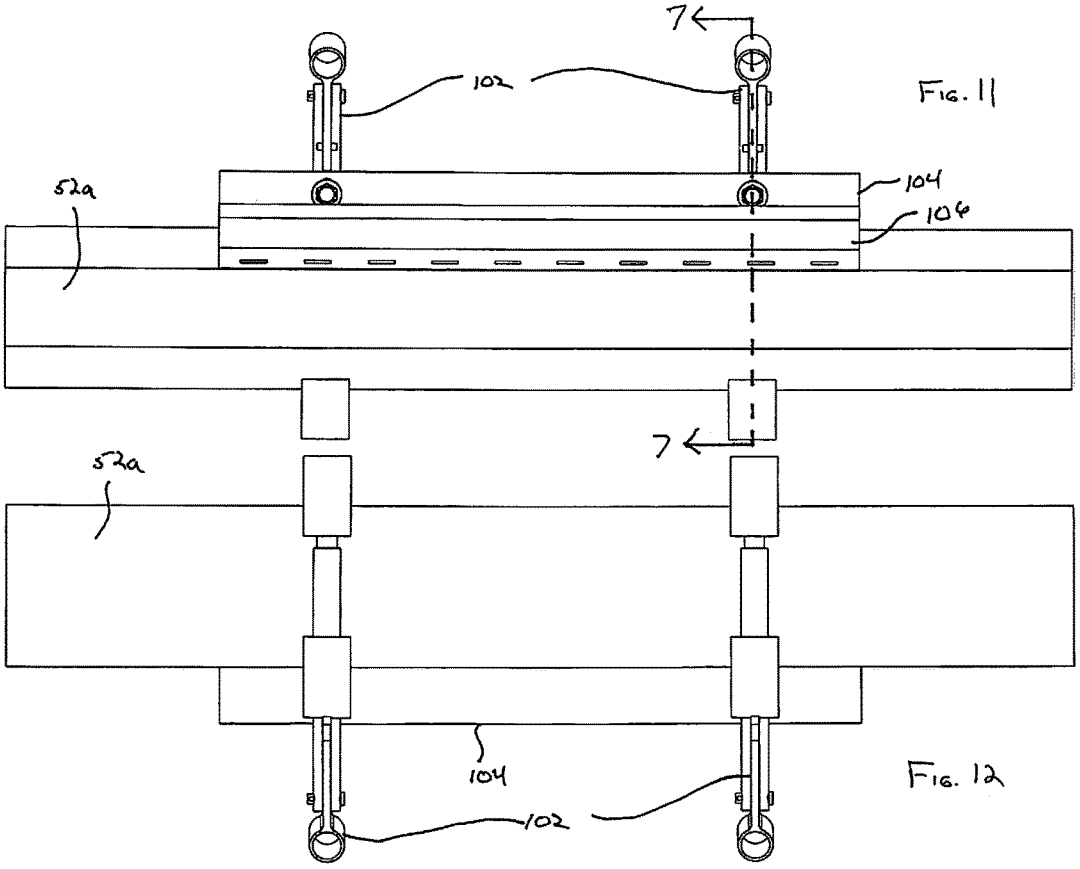
FIG. 11 is a top view of the gauge-face lubrication assembly of FIG. 4.
FIG. 12 is a bottom view of the gauge-face lubrication assembly of FIG. 4.
Figure 13:
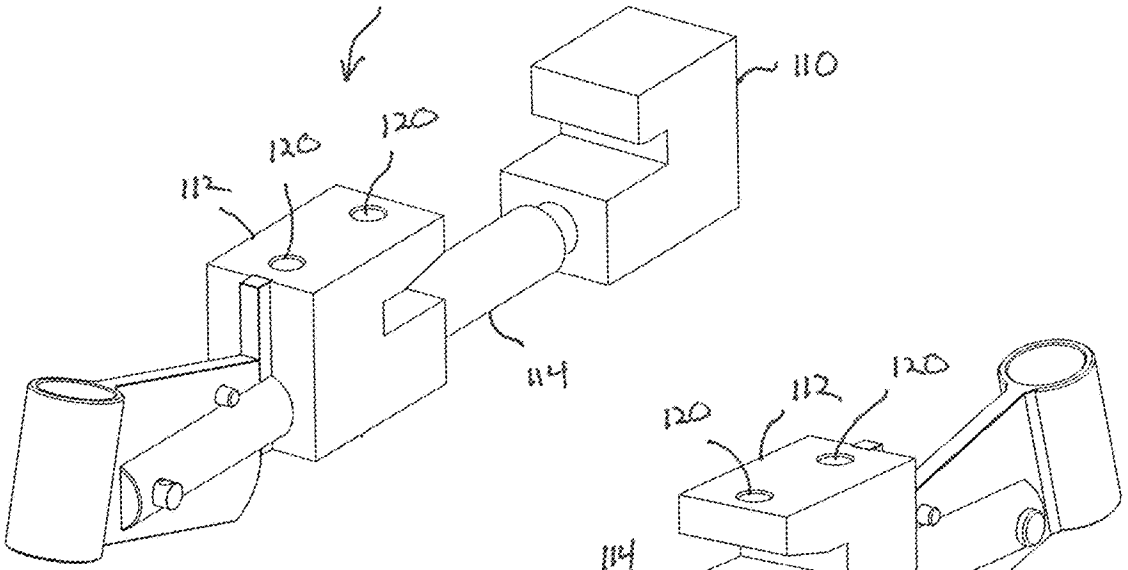
FIG. 13 is a perspective view of a rail clamp assembly according to a representative embodiment of the present invention.
Figure 14:
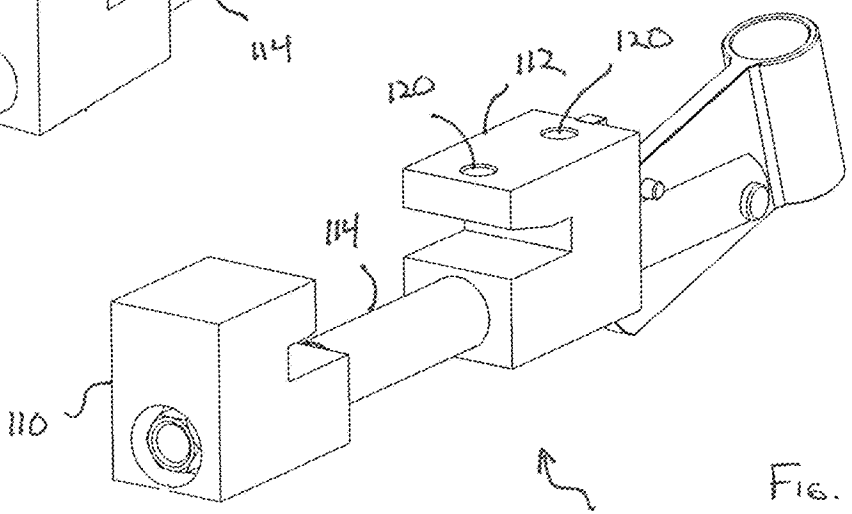
FIG. 14 is a perspective view of the rail clamp assembly of FIG. 13.
Figure 15:
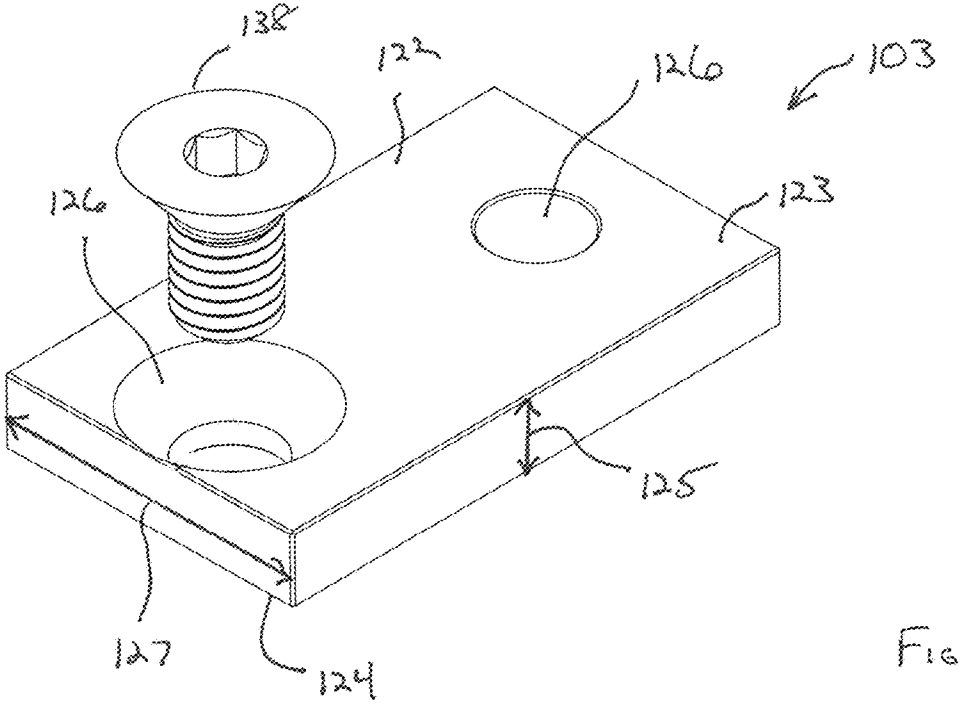
FIG. 15 is a top, perspective view of a vertical positioning member according to a representative embodiment of the present invention.
Figures 16, 17:
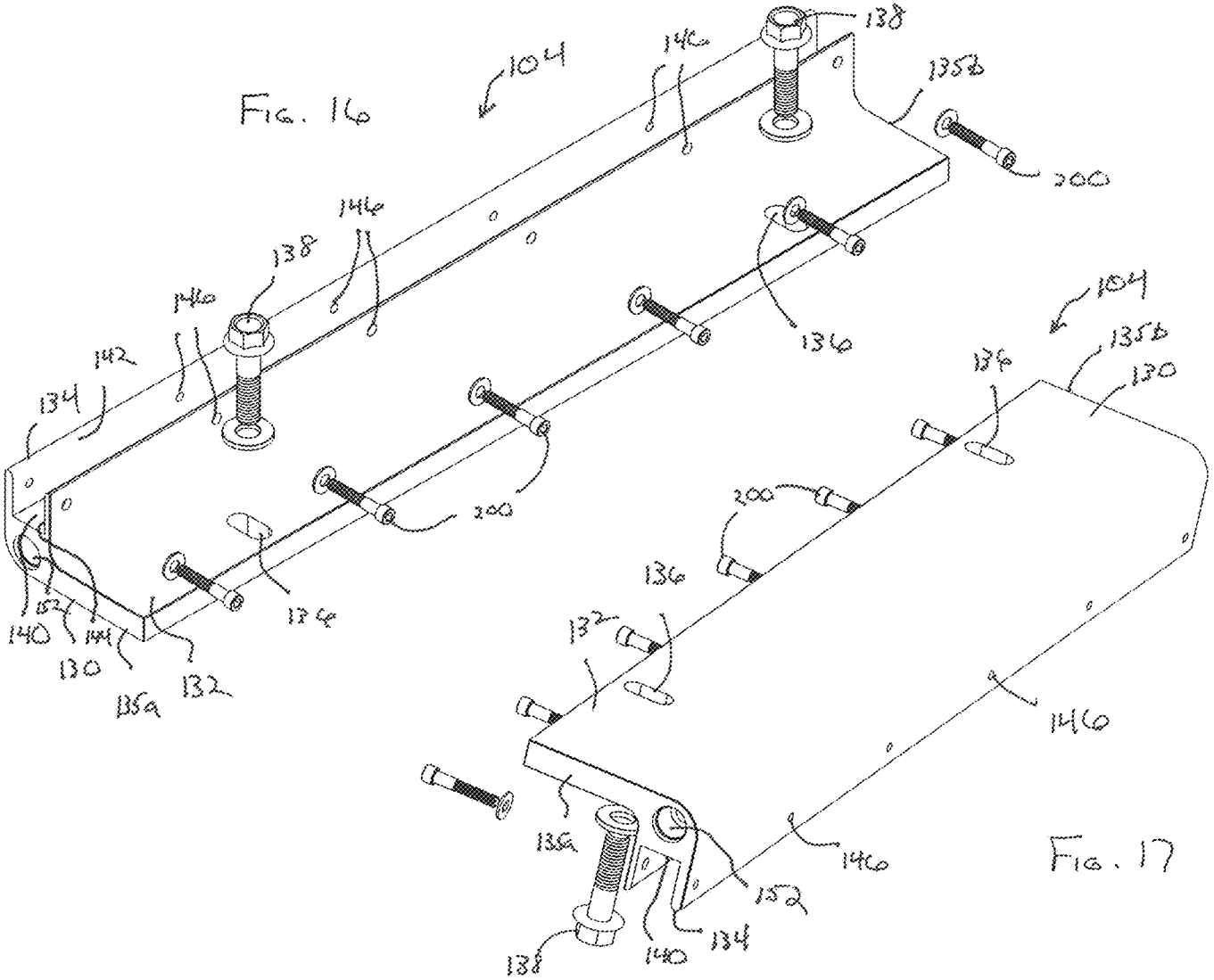
FIG. 16 is a gauge-side, top perspective view of a bracket assembly according to a representative embodiment of the present invention.
FIG. 17 is a bottom, perspective view of the bracket assembly of FIG. 16.
Figure 18:
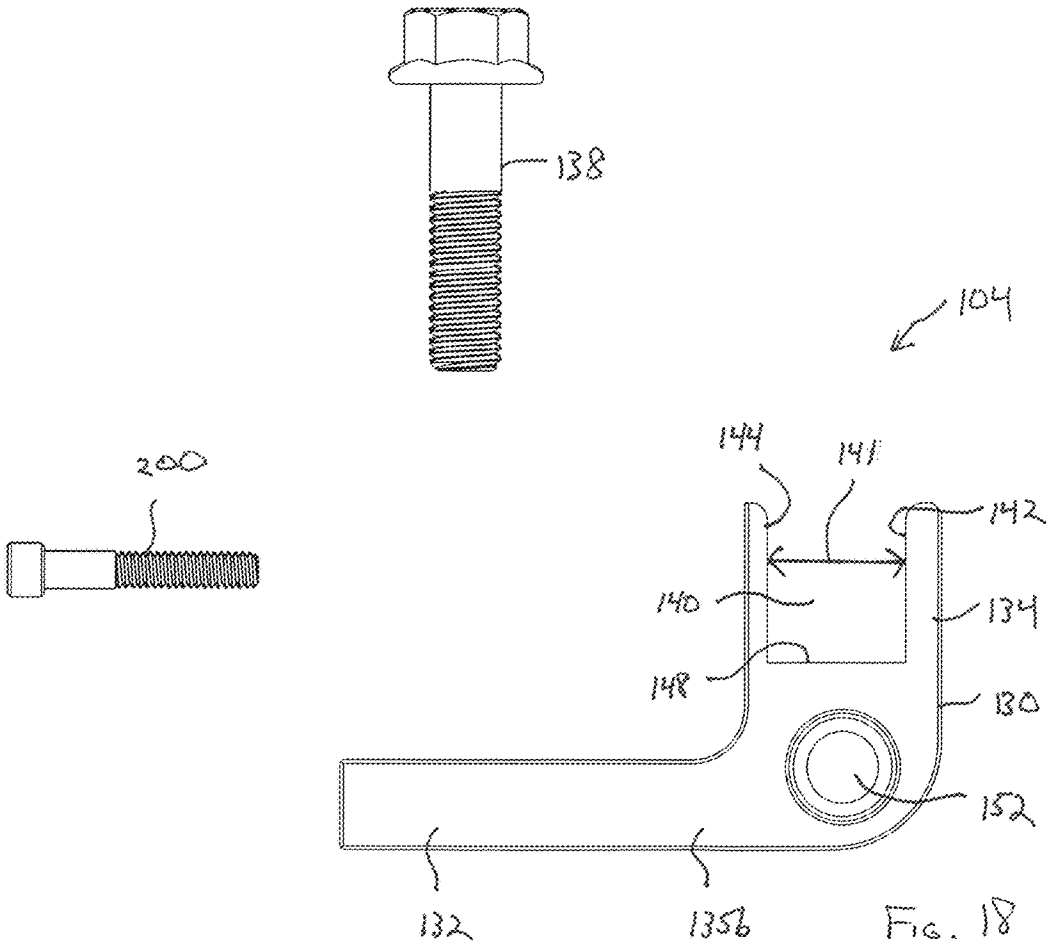
FIG. 18 is an end view of the bracket assembly of FIG. 16.
Figure 19:
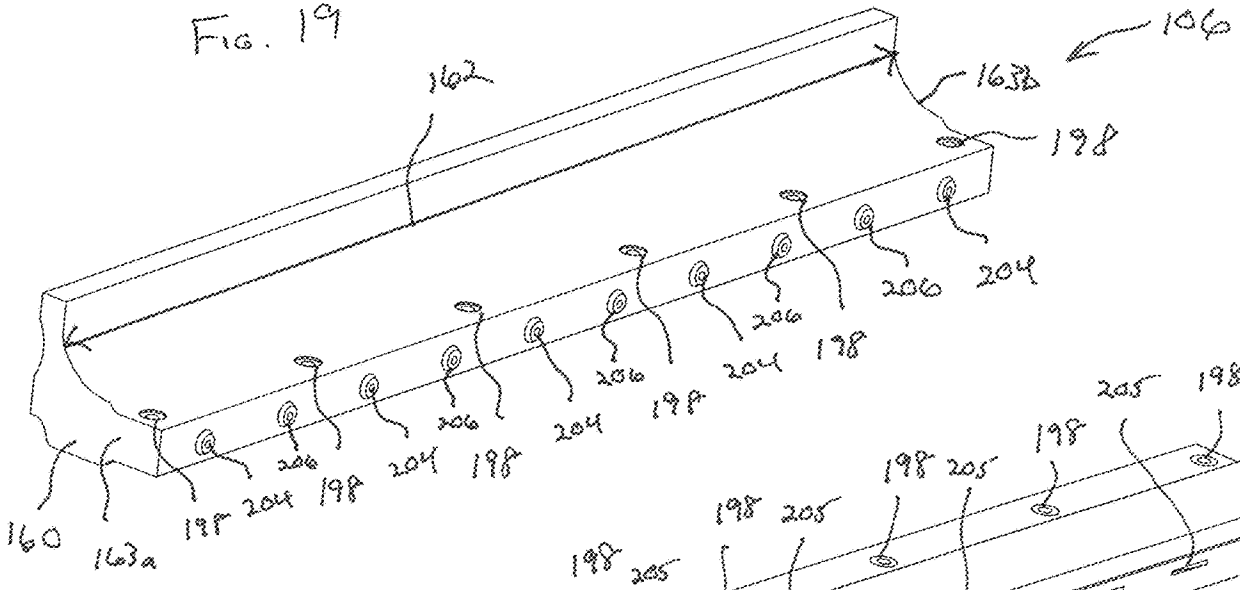
FIG. 19 is a bottom, perspective view of an applicator member according to a representative embodiment of the present invention.
Figure 20:
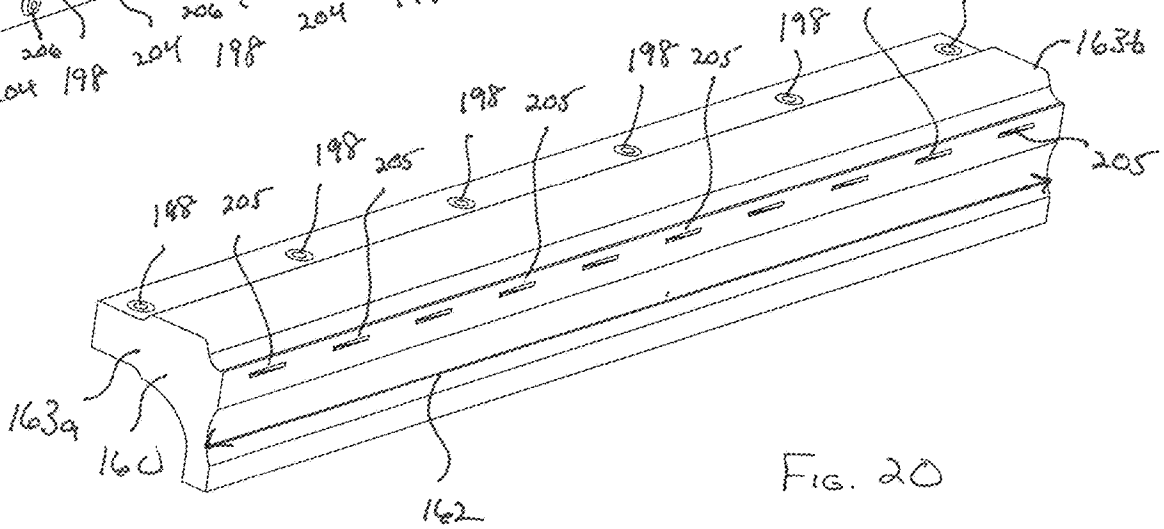
FIG. 20 is a top, perspective view of the applicator member of FIG. 19.
Figure 21:
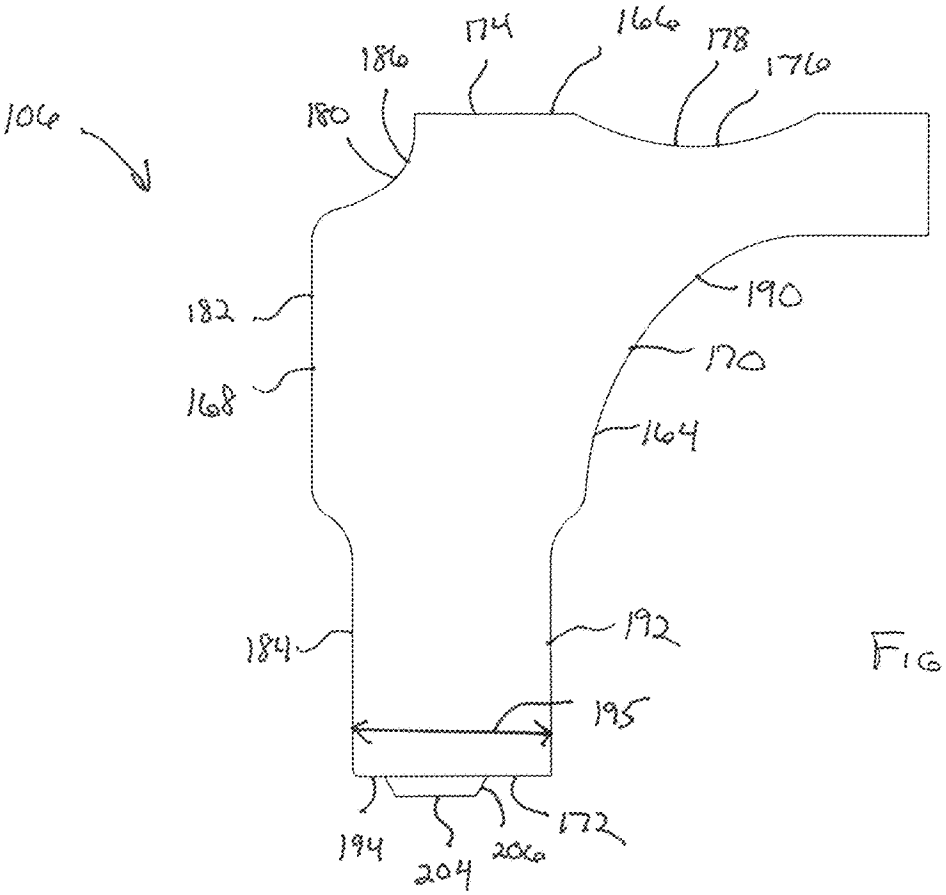
FIG. 21 is an end view of the applicator member of FIG. 19.
Figure 22:
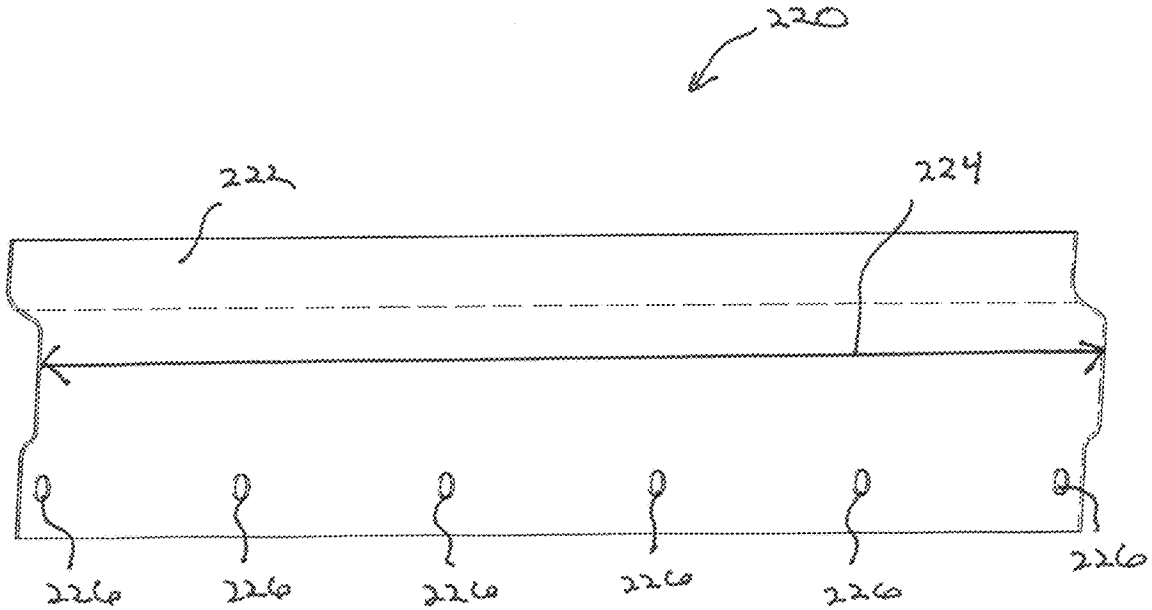
FIG. 22 is a perspective view of an applicator liner according to a representative embodiment of the present invention.
Figure 23:
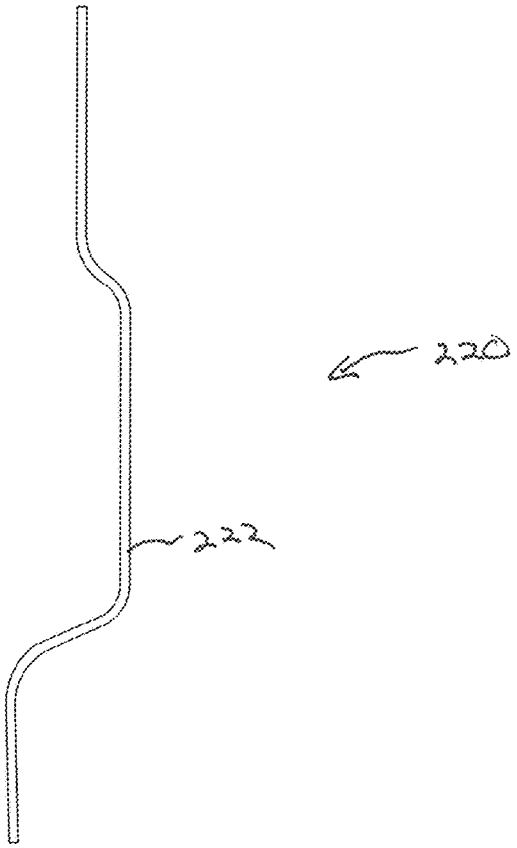
FIG. 23 is an end view of the applicator liner of FIG. 22.
Figure 25:
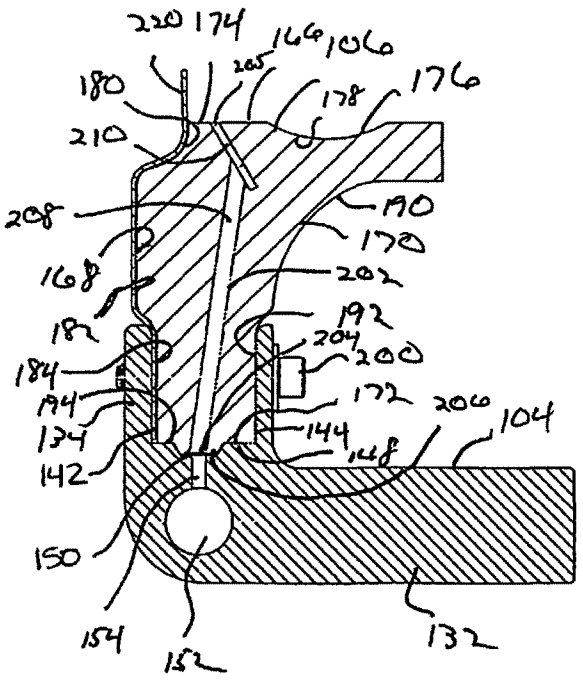
FIG. 25 is a section view of the bracket assembly, applicator member and applicator liner of the gauge-face lubrication assembly of FIG. 4.
Figure 24:
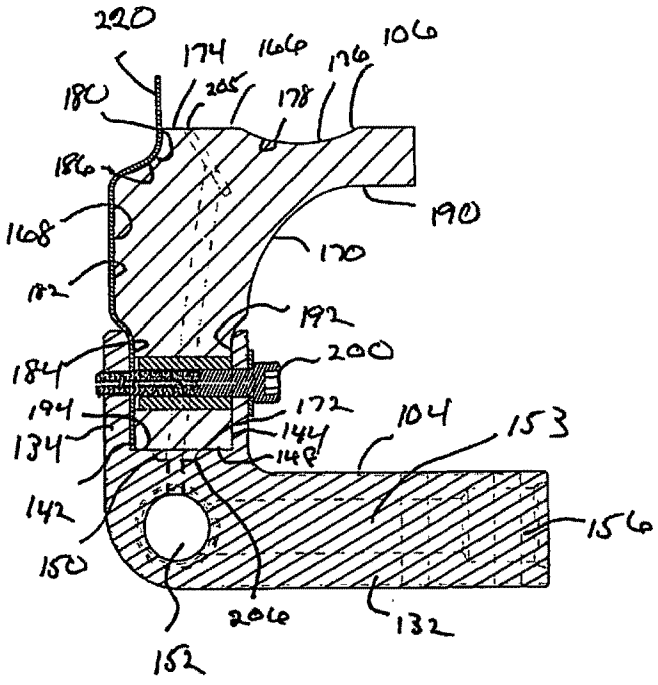
FIG. 24 is a section view of a bracket assembly, applicator member and applicator liner of the gauge-face lubrication assembly of FIG. 4.
Figure 26:
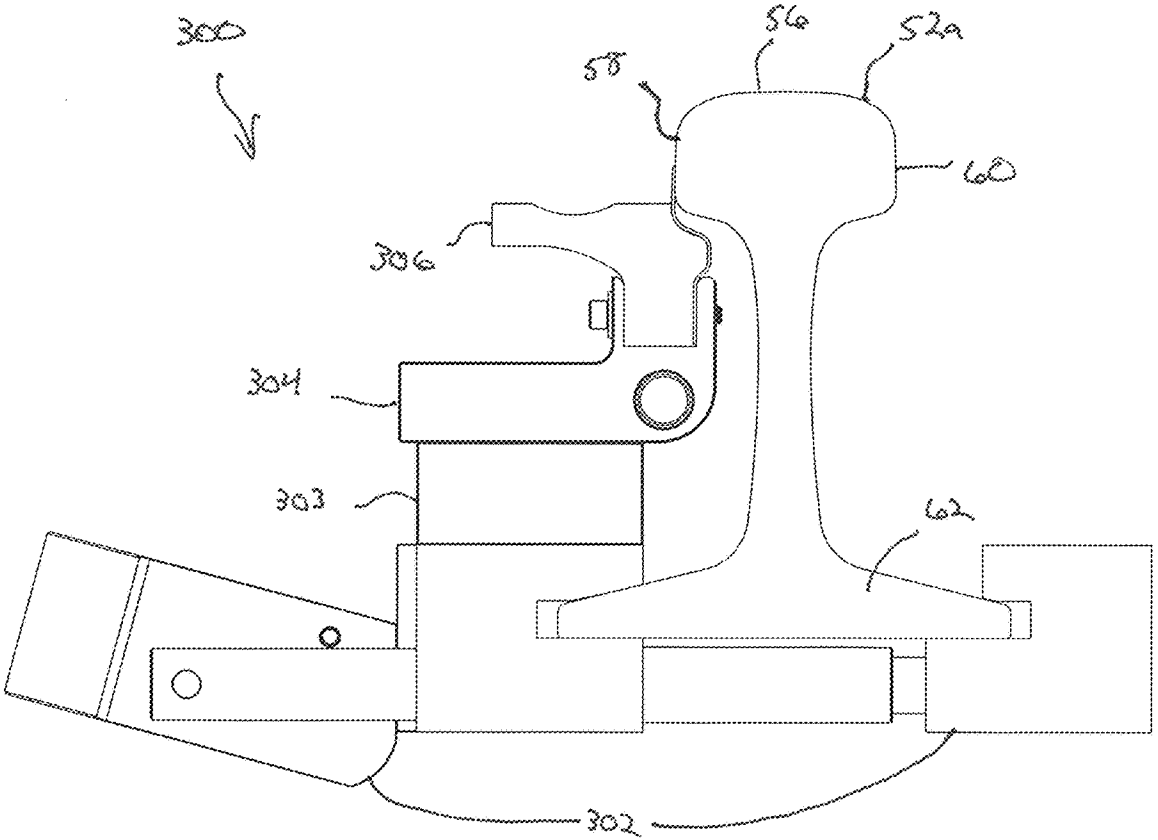
FIG. 26 is an end view of a gauge-face lubrication assembly according to another representative embodiment of the present invention.
Figures 27, 28:
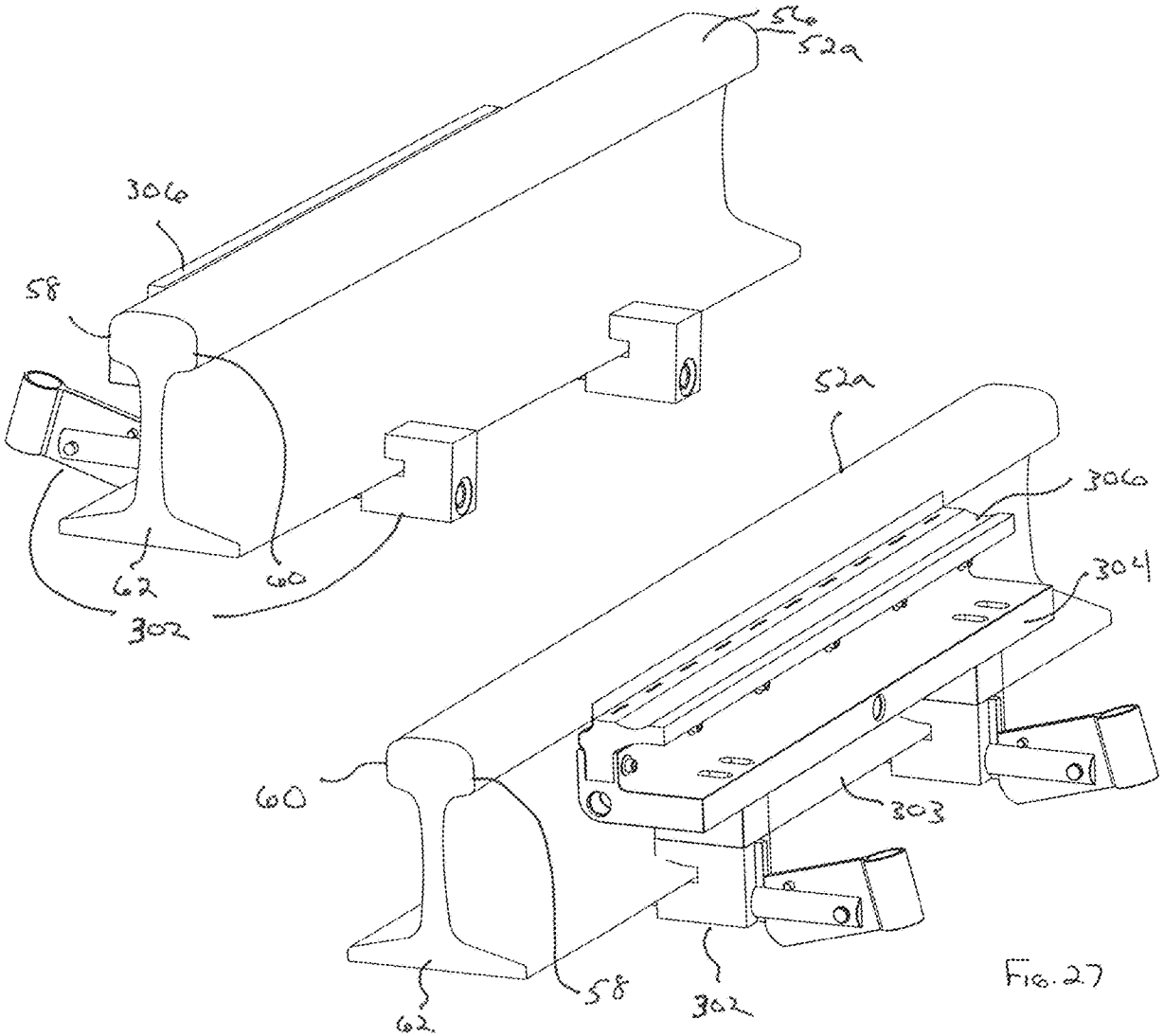
FIG. 27 is a gauge-side perspective view of the gauge-face lubrication assembly of FIG. 26.
FIG. 28 is a field-side perspective view of the gauge-face lubrication assembly of FIG. 26.
Figure 30:
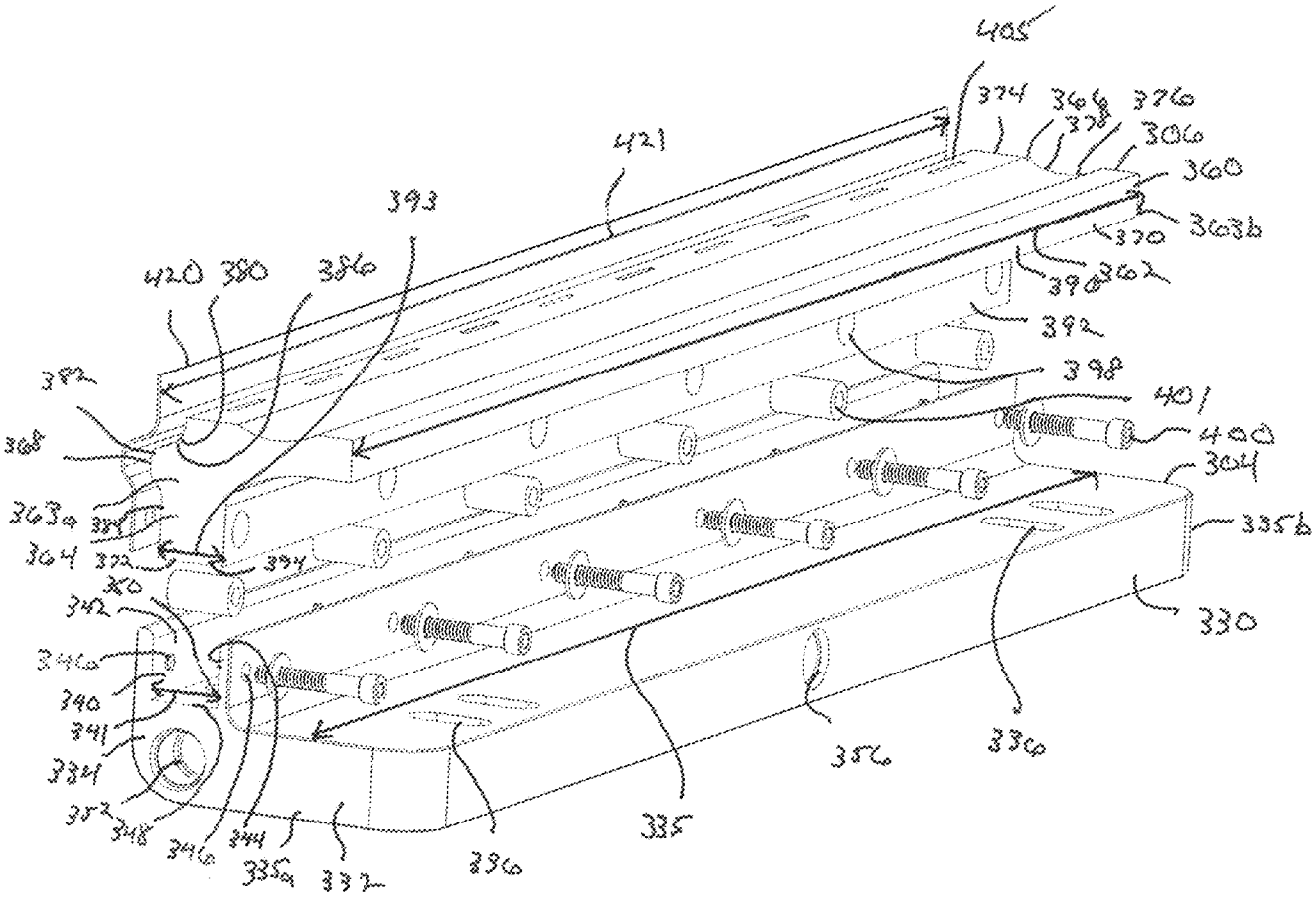
FIG. 30 is a gauge-side, exploded, perspective view of a bracket body, applicator member and applicator liner of the gauge-face lubrication assembly of FIG. 26.
Figure 32:
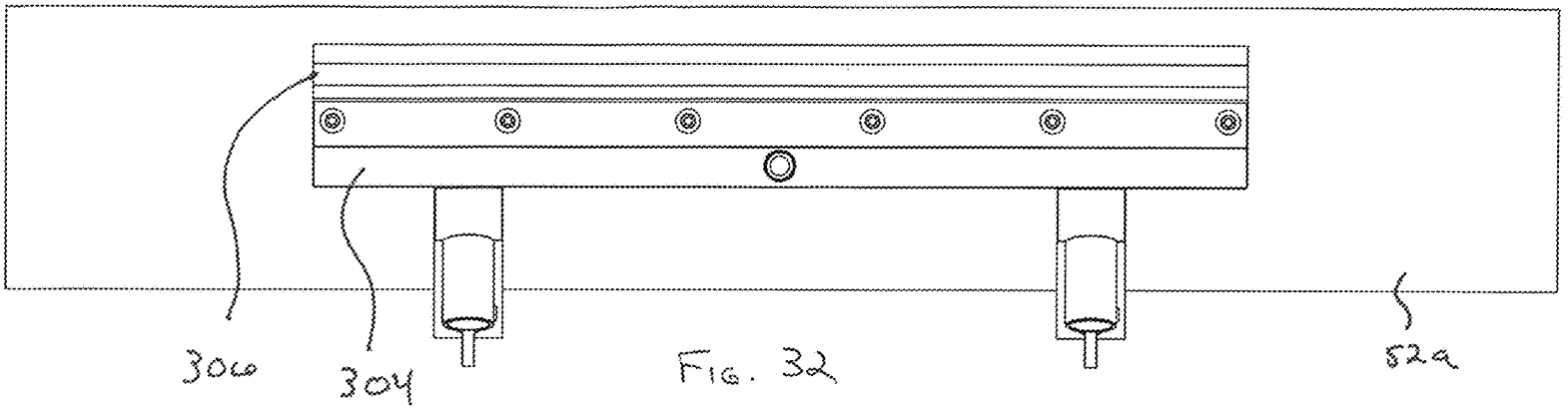
FIG. 32 is a gauge-side view of the gauge-face lubrication assembly of FIG. 26.
Figure 31:
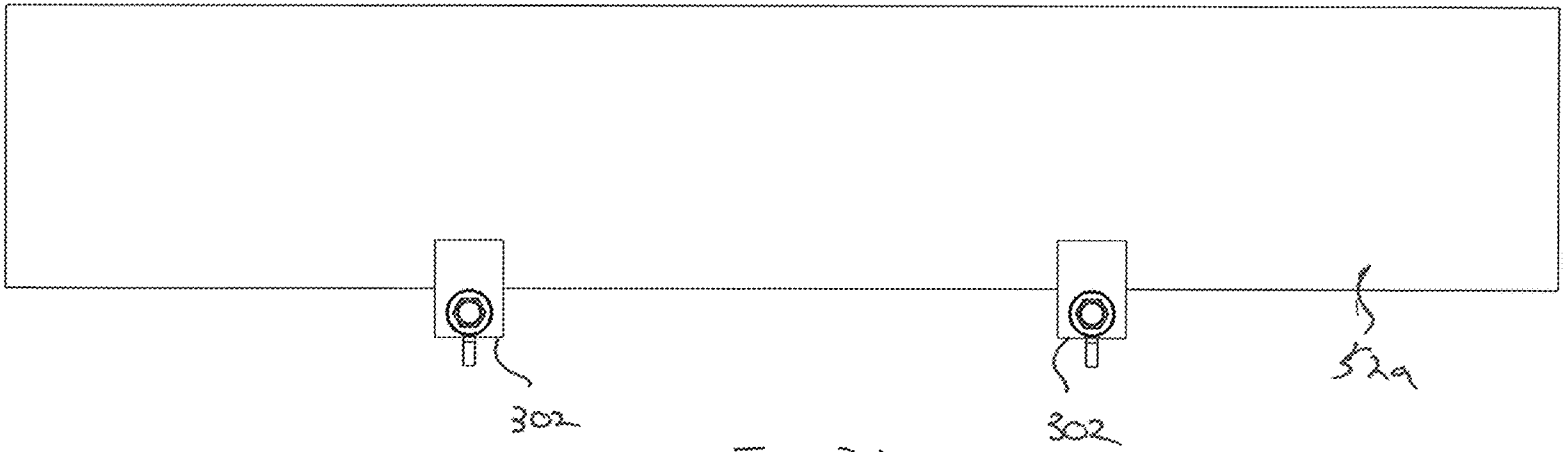
FIG. 31 is a field-side view of the gauge-face lubrication assembly of FIG. 26.
Figures 33, 34:
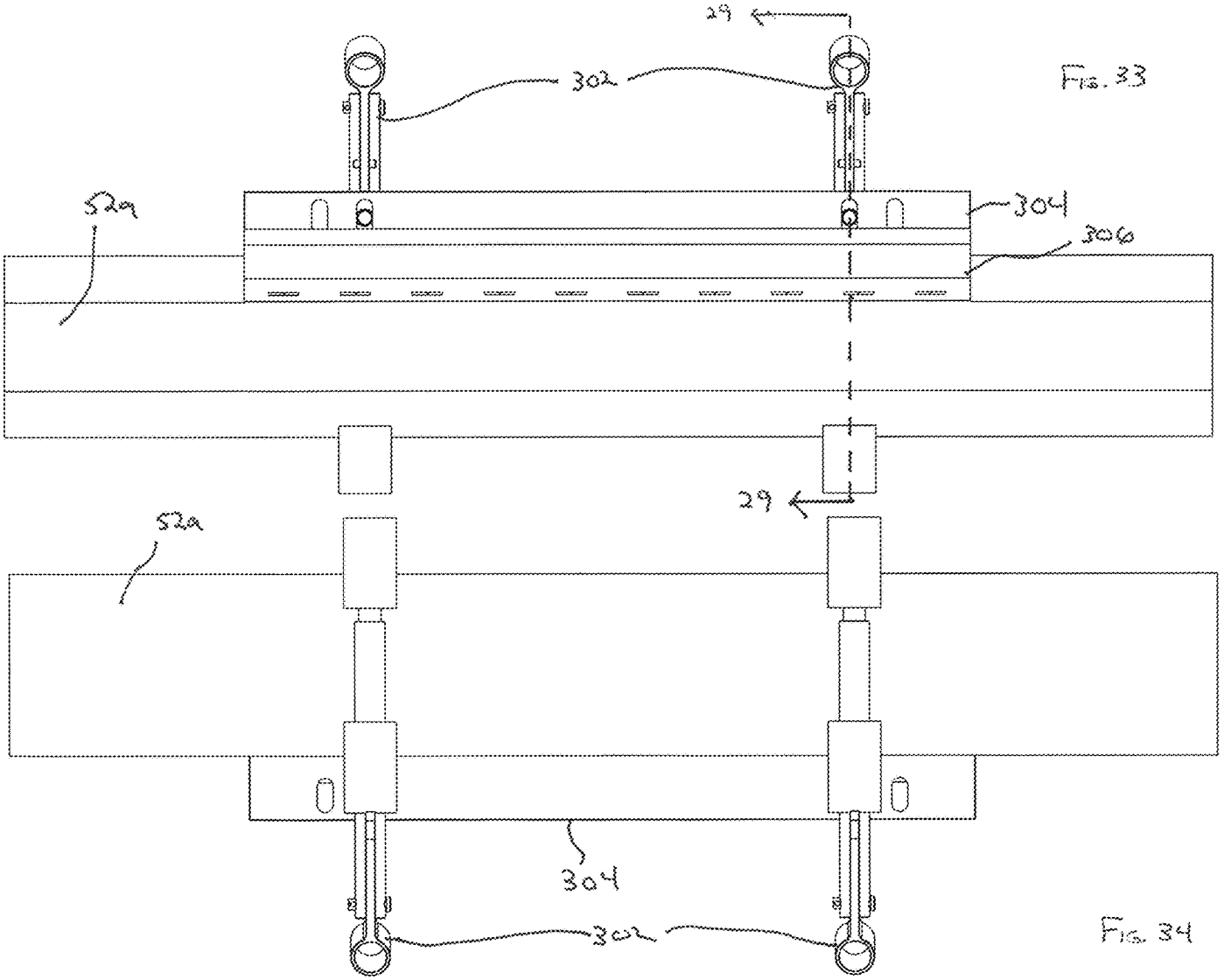
FIG. 33 is a top view of the gauge-face lubrication assembly of FIG. 26.
FIG. 34 is a bottom view of the gauge-face lubrication assembly of FIG. 26.
Figure 35:
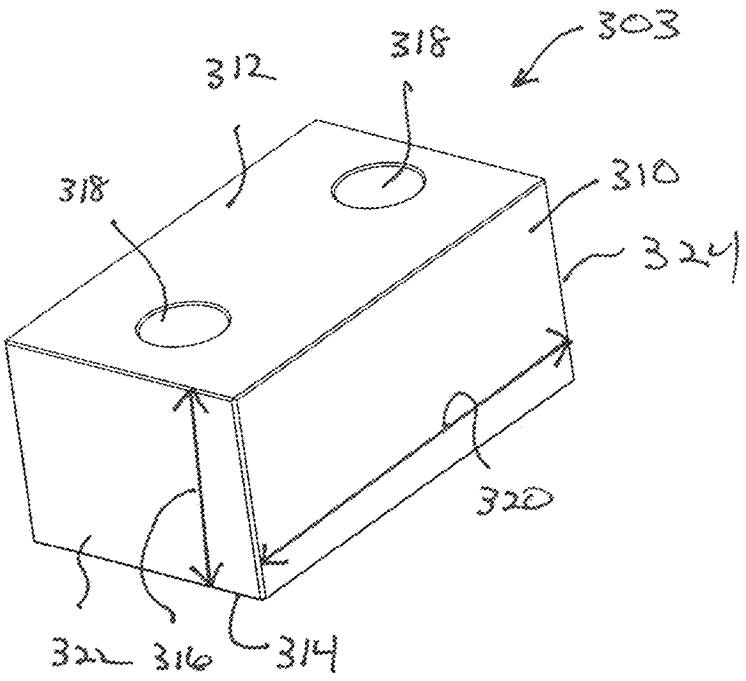
FIG. 35 is a top, perspective view of a vertical positioning member according to a representative embodiment of the present invention.
Figures 36, 37:
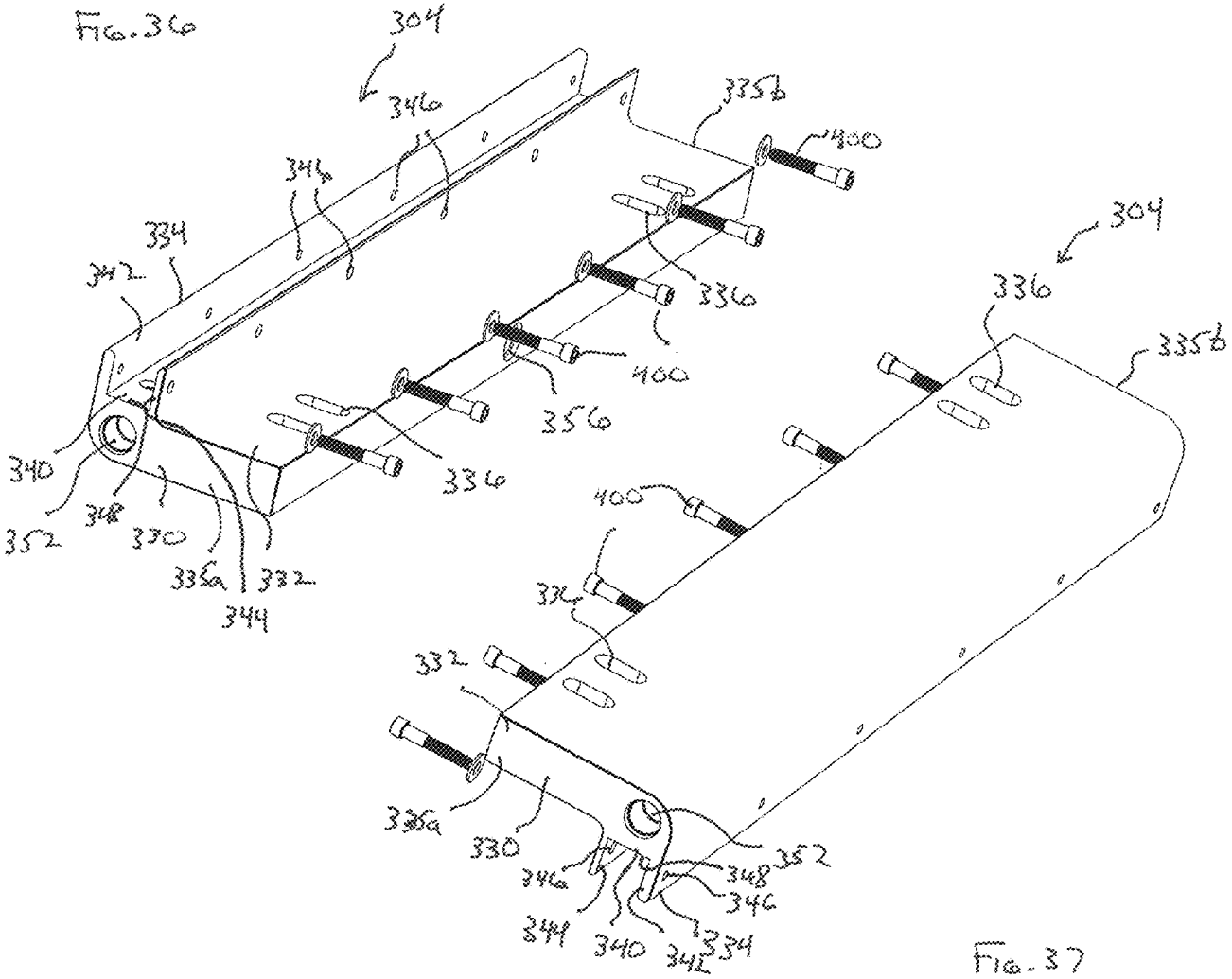
FIG. 36 is a gauge-side, top perspective view of a bracket assembly according to a representative embodiment of the present invention.
FIG. 37 is a bottom, perspective view of the bracket assembly of FIG. 36.
Figure 38:
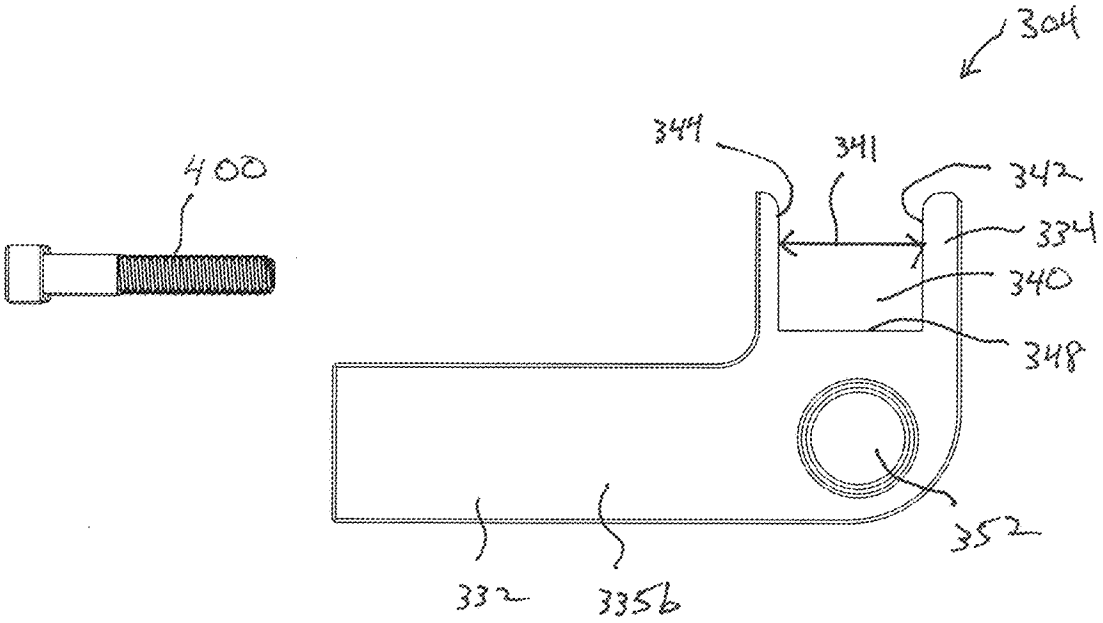
FIG. 38 is an end view of the bracket assembly of FIG. 36.
Figures 39, 40:
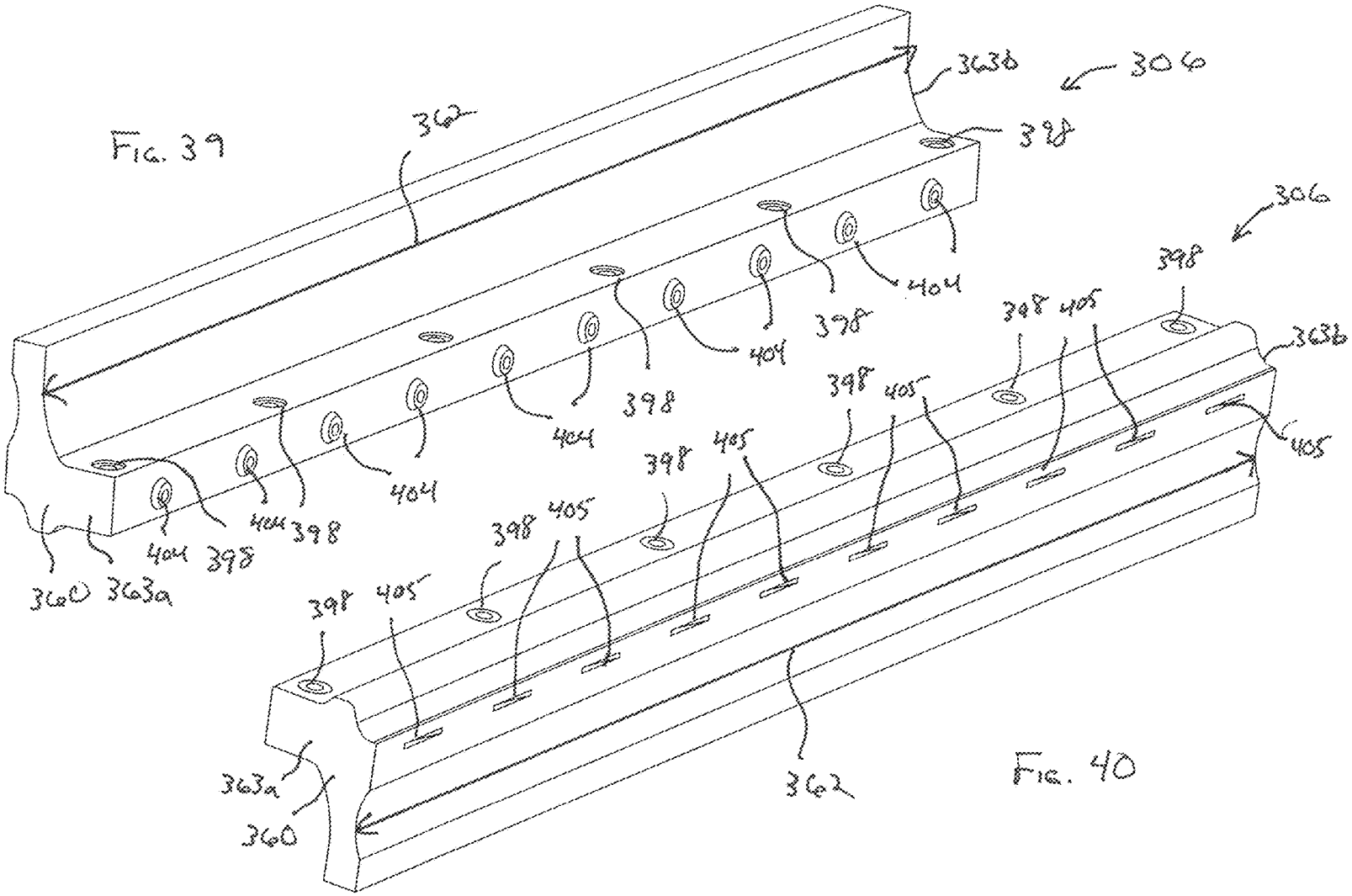
FIG. 39 is a bottom, perspective view of an applicator member according to a representative embodiment of the present invention.
FIG. 40 is a top, perspective view of the applicator member of FIG. 39.
Figure 41:
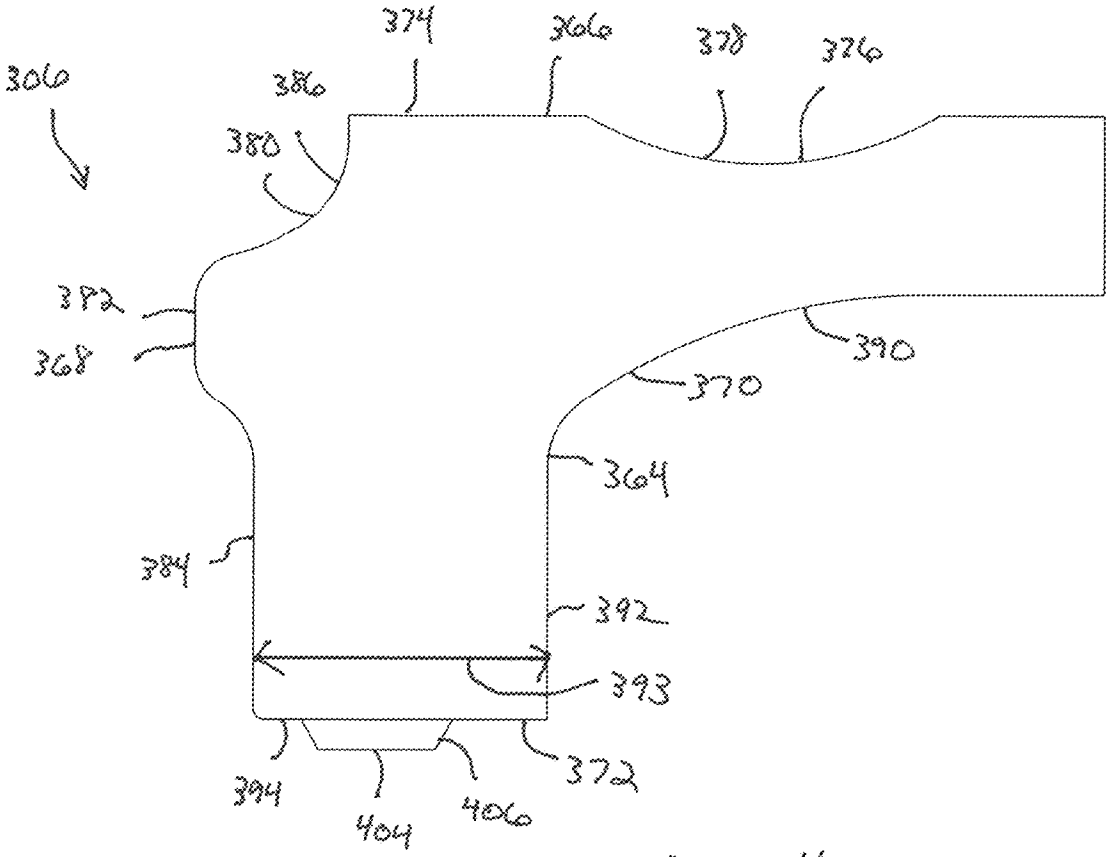
FIG. 41 is an end view of the applicator member of FIG. 39.

Generally, gauge-face lubrication assembly 100 is utilized by first attaching the rail clamp assembly 102 to the rail members 52*a*, 52*b* as shown in FIG. 4. The field side coupling member 110 and gauge side coupling member 112 are positioned to capture the rail base 62 and fastening member 114 is tightened. Either prior to or following the positioning of the gauge side coupling member 112 relative to the rail base 62, the vertical position member 103 and bracket assembly 104 can be coupled to the gauge side coupling member 112 by positioning the vertical positioning member 103 between the gauge side coupling member 112 and the bracket assembly 104 and inserting and tightening the coupling fastener 138 through the coupling aperture 136, the positioning bore 126 and into the mounting aperture 120. Once the vertical position member 103 and bracket assembly 104 are coupled to the rail clamp assembly 102, these components of the gauge-face lubrication assembly 100 remain in position with respect to the rail members 52*a*, 52*b* even as the applicator member 106 is removed and replaced as will be described below.

With the bracket assembly 104 affixed into the desired position relative to the rail members 52*a*, 52*b*, the applicator member 106 and applicator liner 220 are positioned for placement into the applicator cavity 140. In the event that the applicator liner 220 is a reusable, separate component from the applicator member 106, the applicator liner 220 is positioned such that the thin walled body 222 resides against the front applicator wall 142 with the liner fastener apertures 226 aligned with the bracket fastener apertures 146. Next, the applicator engagement portion 196 is inserted into the applicator cavity 140 such that the forward engagement portion 184 is proximate the applicator liner 220 and the rear engagement portion 192 is positioned against the rear applicator wall 144. When the applicator member 106 is properly positioned within the applicator cavity, each inlet seal member 206 sealingly resides within the corresponding cavity recess 150 while the applicator fastener apertures 198 are in alignment with the corresponding liner fastener apertures 226 and bracket fastener apertures 146 for receiving the fasteners 200 to operably couple the applicator member 106 to the bracket assembly 104. Depending upon whether the rigid aperture liners 199 are integrally molded within the applicator member 106 or are removably insertable, the rigid aperture liners 199 can be positioned within the applicator fastener apertures 198 prior to insertion of the applicator engagement portion 196 into the applicator cavity 140.

With the applicator member 106 coupled to the bracket assembly 104, the central lubrication channel 152 is in sealed fluid communication with the lubrication flow channels 202. During a lubricant dispensing event, a proximity sensor in communication with the control system of the remote lubrication supply 72 will indicate the upcoming presence of a passing wheel on a train. The control system will commence operation of the pump such that lubricant form the lubricant reservoir is pumped through the lubricant supply hose 74 and into the bracket lubrication inlet 156, whereby the pressurized lubricant enters the central lubrication channel 152. The pressurized lubricant exits the central lubrication channel 152 through each branch lubrication channel 154. The pressurized lubricant is pumped into the corresponding lubrication inlet 204 on the applicator member 106 with the inlet seal member 206 sealingly engaged within the cavity recesses 150 to prevent leakage of the pressurized lubricant between the bracket assembly 104 and the applicator member 106. The pressurized lubricant flows through the transport portion 208 and into the application portion 210, whereby the application portion 210 is angled to direct the pressurized lubricant out the lubrication outlet 205 and onto, or in proximity to, the gauge-face 58, where a passing wheel flange receives the lubricant. Any excess lubricant drips down onto the application contact portion 174, whereby wheel flanges can contact the upper application surface 166 to receive lubrication. Retention portion 176 accumulates excess lubricant in the arcuate depression 178 to prevent spillage and/or contamination of the surrounding railbed 54 with the lubricant. An upper portion of the applicator liner 220 resides directly against the gauge-face 58 to prevent leakage between the applicator member 106 and the rail member 52*a*, 52*b*. In addition, the applicator liner 220 serves to protect the applicator member 106 by protecting the edges of the upper application surface 166 and the forward surface 168 that may come into physical contact with passing wheel flanges.

Depending upon factors such as, for example, weather and environmental conditions as well as usage of the railway 50 and potential contact with a wheel flange, applicator member 106 can become damaged and/or worn and require replacement. To replace the applicator member 106, maintenance personnel need only remove the fasteners 200 and pull the applicator engagement portion 196 out of the applicator cavity 140, whereby the used applicator member 106 is discarded. The maintenance personnel can then slidably insert the matching applicator engagement portion 196 of a new applicator member 106 into the applicator cavity 140 such that the inlet seal members 206 are positioned within the corresponding cavity recesses 150 and the applicator fastener apertures 198 are aligned with the corresponding liner fastener apertures 226 and bracket fastener apertures 146. As discussed previously, in some embodiments, applicator liner 220 can be permanently coupled to the applicator member 106 such that removal and replacement of the used applicator member 106 includes replacement of the used applicator liner 220 with a new applicator liner 220. Alternatively, the previously used applicator liner 220 can be reused with the new applicator member 106.

In another alternative embodiment as illustrated in FIGS. 26-47, a gauge-face lubrication assembly 300 of the present invention can comprise a low-profile arrangement that can accommodate mounting locations with highly worn rail members 52*a*, 52*b* or when rail ties 64 comprise concrete ties having tall clips. Generally, gauge-face lubrication assembly 300 functions in a manner similar to that previously described with respect to gauge-face lubrication assembly 100 with the further inclusion of features providing accommodation for varying heights of rail.

As illustrated in FIGS. 26-45, gauge-face lubrication assembly 300 comprises a rail clamp assembly 302, a vertical positioning member 303, a bracket assembly 304 and an applicator member 306. Rail clamp assembly 302 is substantially similar to rail clamp assembly 102 in both appearance and function as previously described.

Referring to FIGS. 26, 27, 29 and 35, vertical positioning member 303 generally comprises a body member 310 having an upper surface 312 and a lower surface 314 defining a positioning height 316. The vertical positioning member 303 generally includes a plurality of positioning bores 318 that extend between the upper surface 312 and lower surface 314. Vertical positioning member 303 can have a positioning length 320 between a first end 322 and a second end 324 that corresponds either to a length of the rail clamp assembly, or alternatively, to a length of the bracket assembly 304.

As seen in FIGS. 26, 27, 29, 30, 32-34, 36-38, 44 and 45, bracket assembly 304 can substantially resemble bracket assembly 104 in both appearance and function. Generally, bracket assembly 304 comprises a bracket body 330 including a coupling portion 332 and an applicator portion 334. The bracket body 330 has a bracket length 335 between a first end 335*a* and a second end 335*b* that can range from about 24 to about 72 inches in length. Generally, the coupling portion 332 defines one or more coupling apertures 336 for receiving a coupling fastener 338 that fully inserts through the positioning bores 318 and into the mounting apertures 120 on the rail clamp assembly 302 so as to mechanically couple the bracket assembly 304 to the rail clamp assembly 302, with the vertical positioning member 303 being captured there between. The applicator portion 334 generally defines an applicator cavity 340 having a cavity width 341 defined between a front applicator wall 342 and a rear applicator wall 344. Spaced along bracket length 335, both the front applicator wall 342 and rear applicator wall 344 include a plurality of corresponding bracket fastener apertures 346. The applicator cavity 340 defines a cavity floor 348 that includes a plurality of spaced apart cavity recesses 350 along the bracket length 335. The bracket body 330 includes a central lubrication channel 352 along the bracket length 335 with a plurality of branch lubrication channels 354 that fluidly interconnect the central lubrication channel 352 with the individual cavity recesses 350. The central lubrication channel 352 is supplied by an inlet channel 355 having a bracket lubrication inlet 356 that is fluidly connected to the lubricant supply hose 74.

Applicator member 306 as shown in FIGS. 26-32, 33, 39-41, 44 and 45 is generally molded of the same materials and serves the same function as applicator member 106, with a primary difference being the overall height of the applicator member 304. Applicator member 306 generally comprises an applicator body 360 having an applicator length 362 between end walls 363*a*, 363*b*. Applicator length 362 generally corresponds to the bracket length 335, and may also correspond to the positioning length 320. Generally, the applicator member 306 has a side profile 364 defined by an upper application surface 366, a forward surface 368, a rear surface 370 and a lower engagement surface 372. Forward surface 368 and rear surface 370 generally have a reduced height in comparison to forward surface 168 and rear surface 370 as found on the applicator member 106. Upper application surface 366 generally includes an application contact portion 374 and a retention portion 376. Retention portion 376 can comprise an arcuate depression 378 or a similar channel. Forward surface 368 can comprise a notched portion 380, a projecting portion 382 and a forward engagement portion 384. In some embodiments, notched portion 380 can comprise an arcuate region 386 or corner that can be molded to conform to or substantially match with a corresponding engagement region 388 on the gauge-face 58 of the rail member 52*a*. Rear surface 370 generally comprises an exposed rear surface 390 and a rear engagement portion 392. Lower engagement surface 372 generally has a flat bottom surface 394 defining an engagement width 393 between the front engagement portion 384 and the rear engagement portion 392. Engagement width 393 generally matches the cavity width 341 such that an applicator engagement portion 396 is slidably insertable into the applicator cavity 340. Applicator member 306 further comprises a plurality of applicator fastener apertures 398 extending between the forward engagement portion 384 and the rear engagement portion 392. The quantity and position of the applicator fastener apertures 398 generally correspond with the quantity and position of the bracket fastener apertures 346 such that fasteners 400 can selectively couple and uncouple the applicator member 306 from the bracket assembly 304. A rigid aperture liner 401 can be removably inserted or otherwise molded into the applicator fastener apertures 398 to provide additional retention strength to the applicator member 306.

With reference to FIGS. 8-11, applicator member 306 defines a plurality of lubrication flow channels 402 spaced along applicator length 362. Each lubrication flow channel 402 generally include a lubrication inlet 404 defined in the lower engagement surface 372 and a lubrication outlet 405 defined in the upper application surface 366. An inlet seal member 406 can be molded to each lubrication inlet 404. The position of the lubrication flow channels 402 and each lubrication inlet 404 along the applicator member 306 generally corresponds to the position of the branch lubrication channels 354 along the bracket length 335 of the bracket body 330. As the applicator engagement portion 396 is inserted into the applicator cavity 340, each inlet seal member 406 can be placed into the corresponding cavity recess 350, such that the lubrication inlet 404 is fluidly interconnected with and sealingly engaged to the corresponding branch lubrication channel 354. In order to promote even application of lubrication along the length of the applicator member 306, the diameter of the lubrication flow channels 402 may be varied based upon their distance from a lubrication source on the central lubrication channel 352. Each lubrication flow channel 352 generally comprises a transport portion 408 and an application portion 410. Application portion 410 resides at an angle such that as the lubricant exits the lubrication outlet 405, the lubricant is dispensed at and/or sprayed directly onto the gauge-face 58.

Figure 42:
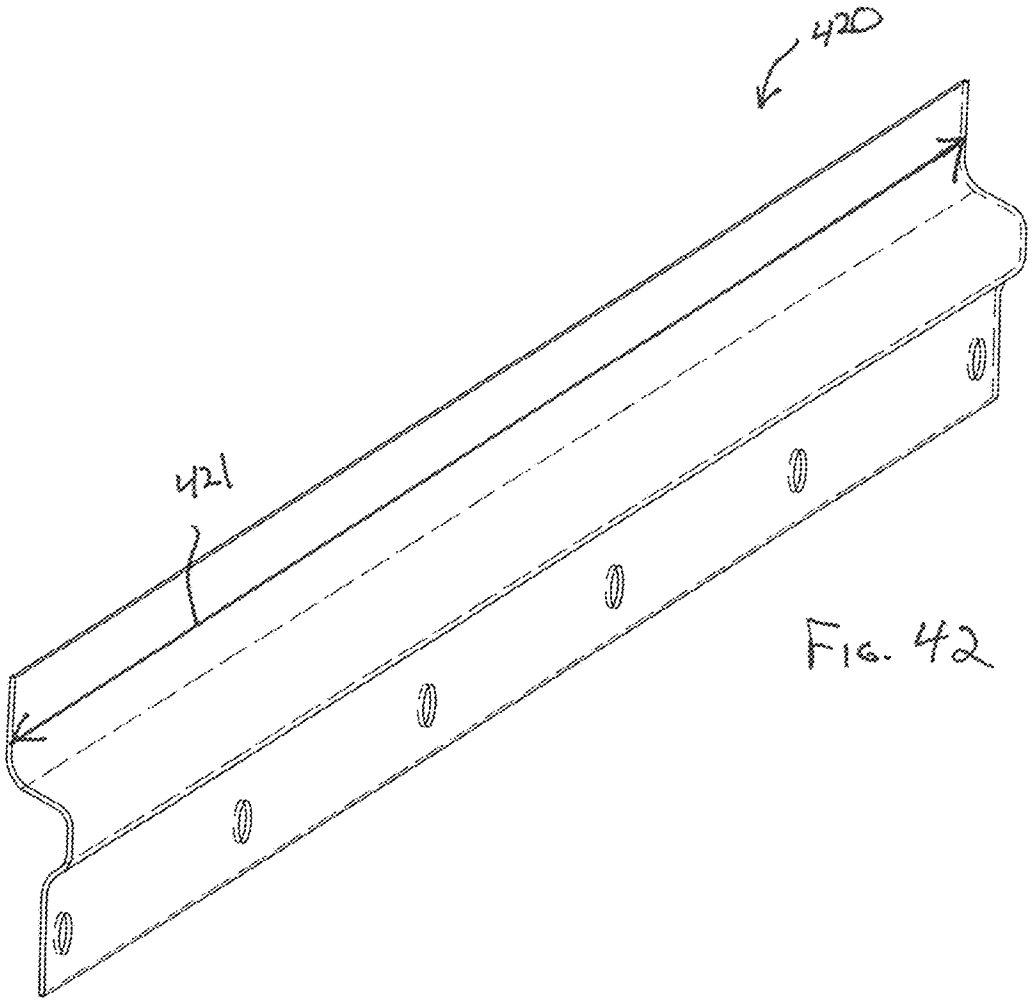
FIG. 42 is a perspective view of an applicator liner according to a representative embodiment of the present invention.
Figure 43:
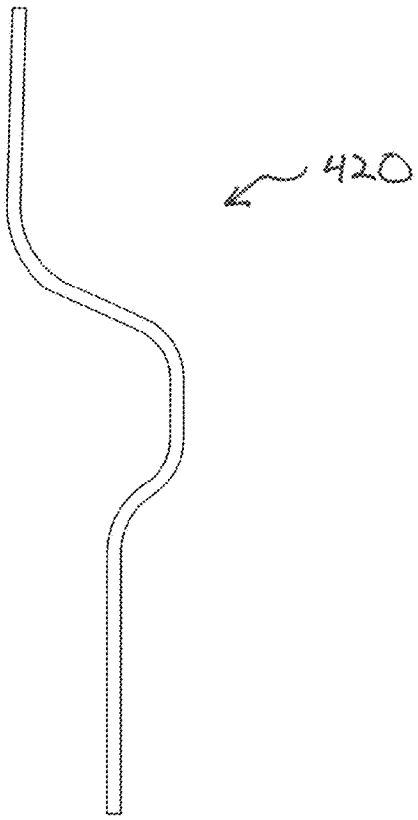
FIG. 43 is an end view of the applicator liner of FIG. 42.
Figure 45:
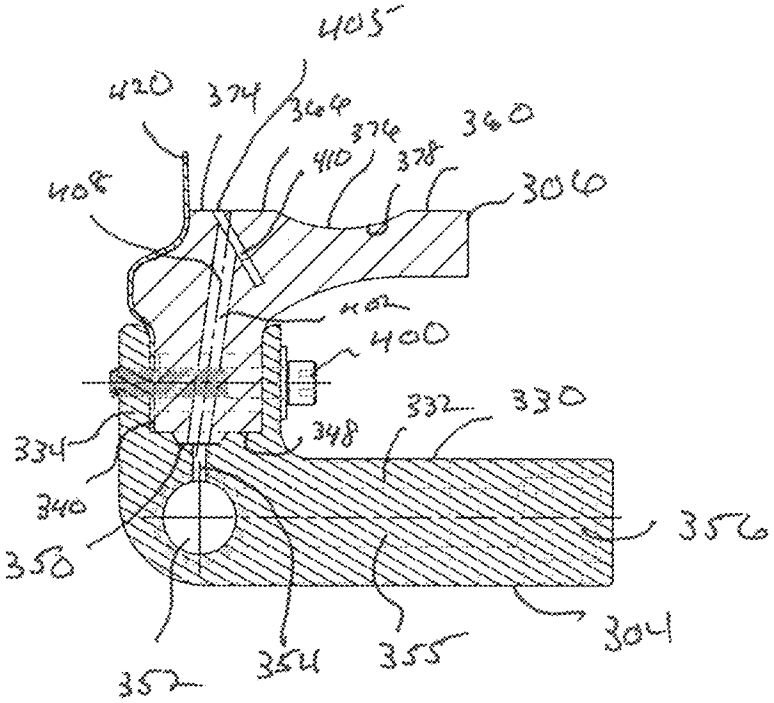
FIG. 45 is a section view of the bracket assembly, applicator member and applicator liner of the gauge-face lubrication assembly of FIG. 26.
Figure 44:
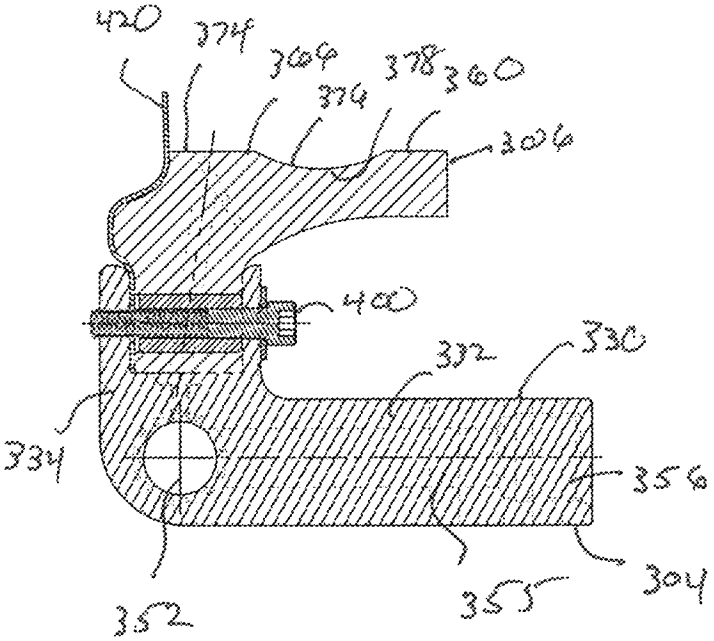
FIG. 44 is a section view of a bracket assembly, applicator member and applicator liner of the gauge-face lubrication assembly of FIG. 26.

Gauge-face lubrication assembly 300 can further comprise an applicator liner 420 having a liner length 421 as shown in FIGS. 42 and 43. Applicator 420 substantially resembles applicator liner 220 in looks and appearance with the exception of having a shorter liner height that corresponds with the reduced height of the forward surface 368 and rear surface 370 as compared to the corresponding surfaces on applicator member 106.

Generally, the mounting and use of the gauge-face lubrication assembly 300 is substantially similar to that of gauge-face lubrication assembly 100 with the exception of capturing the vertical positioning member 303 between the rail clamp assembly 302 and bracket assembly 304. By selectively fabricating the vertical positioning member 303 to have installation specific positioning heights 316, gauge-face lubrication assembly 300 can be utilized in almost any installation, including installations having highly worn rail members 52*a*, 52*b* or when rail ties 64 comprise concrete ties having tall clips. In this way, the parts that are more complex and expensive to fabricate, i.e., the rail clamp assembly 302 and bracket assembly 304 or which are replaceable, i.e., the applicator member 306, can be standardized but still be used in mounting locations having differing mounting requirements through the simple fabrication of vertical positioning members 303 having a desired and location specific positioning height 316.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents.

The invention claimed is:

1. A replaceable rail lubrication applicator, comprising:

a molded applicator member, the molded applicator member having an applicator length between a pair of end walls, the molded applicator member defining a side profile including an upper application surface, a forward surface, a rear surface and a lower engagement surface, wherein a plurality of spaced apart lubrication flow channels are defined between the lower engagement surface and the upper application surface, wherein each lubrication flow channel includes a lubrication inlet in the lower engagement surface and a lubrication outlet on the upper application surface and wherein the upper application surface include an application contact portion and a retention portion, wherein the retention portion comprises an arcuate depression.

2. The replaceable rail lubrication applicator of claim 1, wherein each lubrication inlet further comprises an inlet seal member molded to each lubrication inlet.

3. The replaceable rail lubrication applicator of claim 1, wherein each lubrication flow channel includes a transport portion and an application portion, wherein the transport portion is fluidly connected to the lubrication inlet and the application portion is fluidly connected to the lubrication outlet.

4. The replaceable rail lubrication applicator of claim 3, wherein the application portion intersects the upper application surface at an angled, non-transverse orientation.

5. The replaceable rail lubrication applicator of claim 1, wherein the forward surface, the rear surface and the lower engagement surface define an applicator engagement portion, wherein the applicator engagement portion includes a plurality of spaced apart molded fastener apertures extending between the front surface and the rear surface.

6. The replaceable rail lubrication applicator of claim 5, wherein each molded fastener aperture includes a rigid aperture liner.

7. The replaceable rail lubrication applicator of claim 1, wherein the forward surface comprises an arcuate region adapted to engage a corresponding region on a gage face of a rail member.

8. The replaceable rail lubrication applicator of claim 1, further comprising an applicator liner residing along the forward surface.

9. A gauge-face lubrication assembly including the replaceable rail lubrication applicator of claim 1.

10. A method for lubricating a gauge-face of a rail member with the replaceable rail lubrication applicator of claim 1, comprising:

applying a lubricant with the replaceable rail lubrication applicator of claim 1.

11. A gauge face lubrication assembly, comprising:

a rail clamp assembly for attaching to a rail member;

a vertical positioning member coupled to the rail clamp on a gauge-side of the rail member, the vertical positioning member including an upper surface and a lower surface defining a positioning height there between;

a bracket assembly mounted to the upper surface of the vertical positioning member, the bracket assembly including a bracket body defining a coupling portion and an applicator portion and having a bracket length defined between a first bracket end and a second bracket end, the bracket body including a central lubrication channel extending between the first bracket end and the second bracket end, the central lubrication channel being fluidly connected to a plurality of branch lubrication channels that fluidly interconnect to the applicator portion; and a replaceable applicator member having an applicator length corresponding to the bracket length, the replaceable applicator member having an upper application surface between, each lubrication flow channel having a lubrication inlet on a lower engagement surface that is fluidly connected to a corresponding one of the branch lubrication channels, and each lubrication flow channel having a lubrication outlet defined on the upper application surface for directing a lubricant onto a gauge-face of the rail member, and wherein the applicator portion defines an applicator cavity including a cavity floor, wherein the applicator cavity is adapted so as to slidably receive an applicator engagement portion of the replaceable applicator body such that the lower engagement surface resides against the cavity floor.

12. The gauge-face lubrication assembly of claim 11, wherein the positioning height of the vertical positioning member is selected so as to place a forward surface of the replaceable applicator member in contact with the gauge-face of the rail member.

13. The gauge-face lubrication assembly of claim 11, wherein the bracket assembly includes a bracket lubrication inlet fluidly connected to the central lubrication channel for supplying the lubricant.

14. The gauge-face lubrication assembly of claim 11, wherein each branch lubrication channel intersects with the cavity floor at a cavity recess.

15. The gauge-face lubrication assembly of claim 14, wherein each lubrication inlet includes an inlet seal and wherein each inlet seal resides within the corresponding cavity recess to fluidly couple each branch lubrication channel with each lubrication flow channel.

16. The gauge-face lubrication assembly of claim 11, wherein the applicator engagement portion includes a plurality of applicator fastener apertures defined between a forward surface and a rear surface of the replaceable applicator member, said applicator fastener apertures corresponding to a plurality of bracket fastener apertures defined in a front applicator wall and rear applicator wall of the applicator cavity, whereby said applicator fastener apertures and said bracket fastener apertures align so as to allow removable attachment of the replaceable applicator member to the bracket assembly.

17. The gauge-face lubrication assembly of claim 16, further comprising an applicator liner residing along the forward surface of the replaceable applicator member, said applicator liner including a plurality of liner fastener apertures that correspond to the applicator fastener apertures and the bracket fastener apertures such that the applicator liner can be attached to the bracket assembly.

18. The gauge-face lubrication assembly of claim 17, whereby the applicator liner is molded to the forward surface of the replaceable applicator member.

19. A replaceable rail lubrication applicator, comprising:

a molded applicator member, the molded applicator member having an applicator length between a pair of end walls, the molded applicator member defining a side profile including an upper application surface, a forward surface, a rear surface and a lower engagement surface, wherein a plurality of spaced apart lubrication flow channels are defined between the lower engagement surface and the upper application surface, wherein each lubrication flow channel includes a lubrication inlet in the lower engagement surface and a lubrication outlet on the upper application surface and wherein the forward surface includes an arcuate region adapted to engage a corresponding region on a gage face of a rail member.

* * * * *